US009129769B2

(12) United States Patent
Wang et al.

(10) Patent No.: US 9,129,769 B2
(45) Date of Patent: Sep. 8, 2015

(54) PROTECTIVE DEVICE

(75) Inventors: Chung-Hsiung Wang, Hsinchu (TW); Hung-Ming Lin, Hsinchu County (TW); Wen-Shiang Luo, Taipei (TW); Chun-Tiao Liu, Hsinchu (TW); Kuo-Shu Chen, Taoyuan County (TW)

(73) Assignee: CYNTEC CO., LTD., Hsinchu (TW)

( * ) Notice: Subject to any disclaimer, the term of this patent is extended or adjusted under 35 U.S.C. 154(b) by 267 days.

(21) Appl. No.: 12/875,771

(22) Filed: Sep. 3, 2010

(65) Prior Publication Data

US 2011/0057761 A1 Mar. 10, 2011

(30) Foreign Application Priority Data

| | | |
|---|---|---|
| Sep. 4, 2009 | (TW) | 98129874 |
| Apr. 16, 2010 | (TW) | 99111958 |
| May 14, 2010 | (TW) | 99115506 |

(51) Int. Cl.

| | |
|---|---|
| ***H01H 85/48*** | (2006.01) |
| ***H01H 85/02*** | (2006.01) |
| ***H01H 85/00*** | (2006.01) |
| ***H01H 85/041*** | (2006.01) |
| *H01H 69/02* | (2006.01) |
| *H01H 85/046* | (2006.01) |
| *H01H 85/048* | (2006.01) |
| *H01H 85/11* | (2006.01) |
| *H01H 85/46* | (2006.01) |

(52) U.S. Cl.

CPC ..... *H01H 85/48* (2013.01); *H01H 85/0047* (2013.01); *H01H 85/0241* (2013.01); *H01H 85/0411* (2013.01); *H01H 69/022* (2013.01); *H01H 85/046* (2013.01); *H01H 85/048* (2013.01); *H01H 85/11* (2013.01); *H01H 2085/0283* (2013.01); *H01H 2085/466* (2013.01)

(58) Field of Classification Search

CPC . H01H 85/0241; H01H 85/046; H01H 85/11; H01H 85/48; H01H 69/022; H01H 2085/0283; H01H 2085/0414; H01H 85/0047; H01H 85/0411; H01H 85/048; H01H 2085/466

USPC ..... 337/297

See application file for complete search history.

(56) References Cited

U.S. PATENT DOCUMENTS

| | | | | |
|---|---|---|---|---|
| 4,198,617 A * | 4/1980 | Hara | ..... | 337/403 |
| 4,349,805 A * | 9/1982 | Arikawa | ..... | 337/255 |
| 4,608,548 A * | 8/1986 | Borzoni | ..... | 337/201 |

(Continued)

FOREIGN PATENT DOCUMENTS

| | | |
|---|---|---|
| CN | 1795280 A | 6/2006 |
| CN | 1848351 A | 10/2006 |

(Continued)

*Primary Examiner* — Anatoly Vortman
*Assistant Examiner* — Jacob Crum
(74) *Attorney, Agent, or Firm* — Birch, Stewart, Kolasch & Birch, LLP

(57) ABSTRACT

A protective device including a substrate, a conductive section and a bridge element is provided. The conductive section is supported by the substrate, wherein the conductive section comprises a metal element electrically connected between first and second electrodes. The metal element serves as a sacrificial structure having a melting point lower than that of the first and second electrodes. The bridge element spans across the metal element in a direction across direction of current flow in the metal element, wherein the bridge element facilitates breaking of the metal element upon melting.

22 Claims, 14 Drawing Sheets

(56) References Cited

U.S. PATENT DOCUMENTS

| | | | | |
|---|---|---|---|---|
| 5,097,247 | A * | 3/1992 | Doerrwaechter | 337/405 |
| 5,631,621 | A * | 5/1997 | Nakajima | 337/280 |
| 5,659,284 | A * | 8/1997 | Olofsson | 337/290 |
| 5,712,610 | A | 1/1998 | Takeichi et al. | 337/290 |
| 5,777,540 | A * | 7/1998 | Dedert et al. | 337/142 |
| 5,939,969 | A | 8/1999 | Doerrwaechter et al. | |
| 6,078,245 | A * | 6/2000 | Fritz et al. | 337/297 |
| 6,201,679 | B1 * | 3/2001 | Richiuso | 361/103 |
| 6,222,438 | B1 * | 4/2001 | Horibe et al. | 337/290 |
| 6,300,859 | B1 * | 10/2001 | Myong et al. | 337/182 |
| 6,344,633 | B1 | 2/2002 | Furuuchi | 219/517 |
| 6,373,371 | B1 * | 4/2002 | Doerrwaechter et al. | 337/297 |
| 6,452,475 | B1 | 9/2002 | Kawazu et al. | 337/290 |
| 6,566,995 | B2 | 5/2003 | Furuuchi et al. | 337/183 |
| 7,042,327 | B2 * | 5/2006 | Tanaka et al. | 337/290 |
| 7,286,037 | B2 | 10/2007 | Furuuchi | 337/290 |
| 7,535,332 | B2 * | 5/2009 | Furuuchi et al. | 337/182 |
| 7,679,330 | B2 | 3/2010 | Furuuchi et al. | |
| 7,718,308 | B2 * | 5/2010 | Senda et al. | 429/62 |
| 8,289,123 | B2 * | 10/2012 | Whitney et al. | 337/295 |
| 8,547,195 | B2 | 10/2013 | Kimura et al. | |
| 2001/0044168 | A1 | 11/2001 | Furuuchi et al. | |
| 2002/0014945 | A1 * | 2/2002 | Furuuchi et al. | 337/158 |
| 2003/0156007 | A1 * | 8/2003 | Senda et al. | 337/401 |
| 2004/0070486 | A1 * | 4/2004 | Senda et al. | 337/405 |
| 2004/0196133 | A1 * | 10/2004 | Kawanishi | 337/159 |
| 2005/0140491 | A1 * | 6/2005 | Uehara et al. | 337/401 |
| 2005/0141164 | A1 * | 6/2005 | Bender et al. | 361/104 |
| 2005/0264394 | A1 * | 12/2005 | Furuuchi | 337/182 |
| 2006/0028314 | A1 * | 2/2006 | Furuuchi | 337/4 |
| 2006/0125594 | A1 * | 6/2006 | Furuuchi | 337/4 |
| 2006/0214259 | A1 * | 9/2006 | Spaunhorst | 257/529 |
| 2007/0024407 | A1 * | 2/2007 | Senda et al. | 337/159 |
| 2007/0075822 | A1 * | 4/2007 | Pachla et al. | 337/297 |
| 2008/0191832 | A1 * | 8/2008 | Tsai | 337/297 |
| 2009/0009281 | A1 * | 1/2009 | Wang et al. | 337/297 |
| 2010/0085141 | A1 * | 4/2010 | Knab et al. | 337/227 |
| 2010/0109833 | A1 * | 5/2010 | Knab et al. | 337/413 |
| 2010/0245027 | A1 * | 9/2010 | Matthiesen et al. | 337/297 |
| 2010/0245028 | A1 * | 9/2010 | Washizaki et al. | 337/297 |
| 2011/0181385 | A1 * | 7/2011 | Schulze-Icking-Konert et al. | 337/290 |

FOREIGN PATENT DOCUMENTS

| | | | |
|---|---|---|---|
| CN | 1897203 | A | 1/2007 |
| CN | 101373680 | A | 2/2009 |
| JP | 62-043440 | U | 3/1987 |
| JP | 62-107341 | U | 7/1987 |
| JP | 05-174678 | | 7/1993 |
| JP | 07-153367 | | 6/1995 |
| JP | 09-213184 | A | 8/1997 |
| JP | 11-126553 | A | 5/1999 |
| JP | 2000-011831 | | 1/2000 |
| JP | 2001-118481 | | 4/2001 |
| JP | 2001-509945 | A | 7/2001 |
| JP | 2001-222938 | | 8/2001 |
| JP | 2001-325868 | A | 11/2001 |
| JP | 2004-179309 | A | 6/2004 |
| JP | 2004-185960 | A | 7/2004 |
| JP | 2004-265617 | | 9/2004 |
| JP | 2005-129352 | | 5/2005 |
| JP | 2005-150075 | | 6/2005 |
| JP | 4036933 | B2 | 11/2007 |
| JP | 2009-259724 | | 11/2009 |
| TW | 503421 | B | 9/2002 |
| TW | I296122 | B | 4/2008 |
| TW | 200926239 | A | 6/2009 |
| TW | M363673 | | 8/2009 |
| TW | M363674 | | 8/2009 |
| TW | 200949887 | A1 | 12/2009 |
| WO | WO 2011/126091 | A1 | 10/2011 |

* cited by examiner

PROTECTIVE DEVICE

CROSS-REFERENCE TO RELATED APPLICATION

This application claims the priority benefit of Taiwan application serial no. 99111958, filed on Apr. 16, 2010, Taiwan application serial no. 99115506, filed on May 14, 2010 and Taiwan application serial no. 98129874, filed on Sep. 4, 2009. The entirety of each of the above-mentioned patent applications is hereby incorporated by reference herein and made a part of this specification.

BACKGROUND

1. Field of the Invention

The invention relates to a protective device applied to an electronic device, and in particular a protective device capable of preventing over currents and over voltages.

2. Description of Related Art

In recent years, due to booming development of information technology (IT), IT products such as cell phones, computers and personal digital assistants are commonplace. With their help, demands in various aspects such as food, clothing, housing, travelling, education, and entertainment are met, and people increasingly dependent on IT products. However, lately, there has been news about exploding batteries of portable electronic products during charging and discharging. Hence, the industry has enhanced protective measures used during charging and discharging of batteries, so as to prevent explosions of batteries during charging and discharging because of over voltages or over currents.

According to a protection method of the protective device provided by the conventional technique, a temperature fuse in the protective device is serially connected with a circuit of a battery, and the temperature fuse in the protective device and a heater are electrically connected to controlling units such as a field effect transistor (FET) and an integrated circuit (IC). In this way, when the IC senses an over voltage, it drives the FET, so that a current passes through the heater which heats up to melt the temperature fuse, thereby making the circuit of the battery disconnected and achieving protection from over voltages. In addition, when an over current occurs, the massive current flows through the temperature fuse, thereby melting the temperature fuse, so that the circuit of the battery is disconnected to achieve the purpose of protection against over currents.

SUMMARY OF THE INVENTION

An object of the present invention is to provide a protective device, which effectively prevents over currents and over voltages.

In one aspect, the invention provides a protective device including a substrate, a conductive section and a bridge element. The conductive section is supported by the substrate, wherein the conductive section comprises a metal element electrically connected between first and second electrodes. The metal element serves as a sacrificial structure having a melting point lower than that of the first and second electrodes. The bridge element spans across the metal element in a direction across direction of current flow in the metal element, wherein the bridge element facilitates breaking of the metal element upon melting.

In an embodiment of the invention, at least one end of the bridge element is fixedly supported on the substrate.

In an embodiment of the invention, both ends of the bridge element are fixedly supported on the substrate.

In an embodiment of the invention, the protective device further comprises an intermediate support disposed between the metal element and the substrate.

In an embodiment of the invention, at least one end of the bridge element is fixedly supported on the intermediate support.

In an embodiment of the invention, both ends of the bridge element are fixedly supported on the intermediate support.

In an embodiment of the invention, the bridge element comprises an elongated structure.

In an embodiment of the invention, the elongated structure comprises an arc or a bending shape.

In an embodiment of the invention, the protective further comprises an auxiliary medium having a portion disposed between the bridge element and the metal element.

In an embodiment of the invention, the protective device further comprises another auxiliary medium disposed between the metal element and the substrate, wherein said another auxiliary medium having a melting point lower than that of the metal element.

In an embodiment of the invention, the protective device further comprises a heat-generating element supported by the substrate, providing heat to at least the metal element and auxiliary medium.

In an embodiment of the invention, the bridge element and auxiliary medium are positioned in line with the heat generating element.

In an embodiment of the invention, the protective device further comprises an intermediate layer between the metal element and the intermediate support, wherein the intermediate layer has a fusing temperature lower than the melting temperature of the metal element.

In an embodiment of the invention, the auxiliary medium is a flux or a solder layer.

In an embodiment of the invention, the protective device further comprises a heat insulation portion between the heating element and the first and second electrodes, wherein heat transfer to the intermediate support is at a higher rate than that to the first and second electrodes.

In an embodiment of the invention, the intermediate support comprises an extension of an electrode coupled to a heat-generating element.

In an embodiment of the invention, the substrate comprise a first insulating block, and a second insulating block under the first and second electrodes, wherein a thermal conductivity coefficient of the first insulating bock is greater than that of the second insulating block.

According to the above descriptions, the protective device of the invention has the bridge element, so that when the heat-generating element generates heat to melt the metal element, the melted metal element flows towards the contacted bridge element and the intermediate support due to surface tension and a wicking phenomenon (may or may not include capillary action), so as to cut off the circuit to achieve the over voltage protection and the over current protection. Moreover, since the auxiliary medium is embedded in the protective device of the invention, and the auxiliary medium is disposed between the metal element and the heat-generating element, when the heat-generating element generates heat, the melted auxiliary medium effectively helps melting the metal element.

In addition, the protective device of the present invention has a low thermal conductive layer, and when the heat-generating element generates heat and transfers the heat to the third electrode via the substrate, since the first electrode and the second electrode are all obstructed by the low thermal conductive layer, the heat generated by the heat-generating element can be concentratively transferred to the third electrode. Therefore, the metal element located over the third electrode is blown first to reduce a melting amount of the metal element, so as to cut off the circuit and effectively achieve an over voltage protection and an over current protection. On the other hand, according to such design, an adhesive area of the melted metal element can also be effectively controlled, so as to achieve a stable melt time and mode, and meanwhile an alignment error of the heat-generating device and the third electrode generated during the fabrication process can be reduced.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1A:
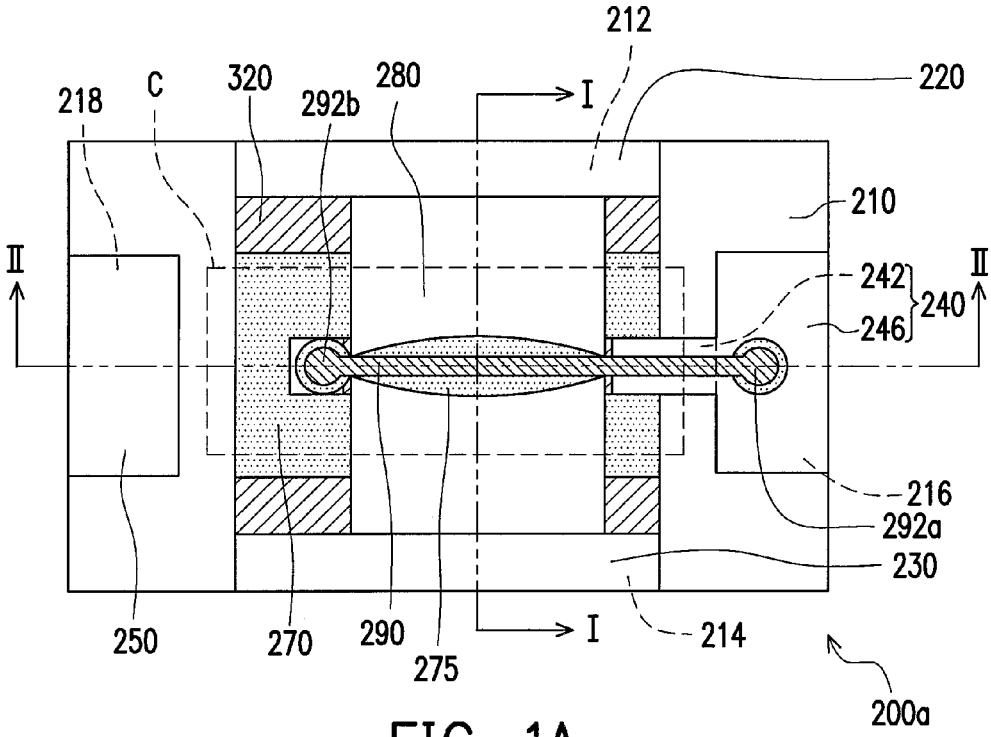
FIG. 1A is a schematic top view of a protective device according to an embodiment of the invention.
Figure 1B:
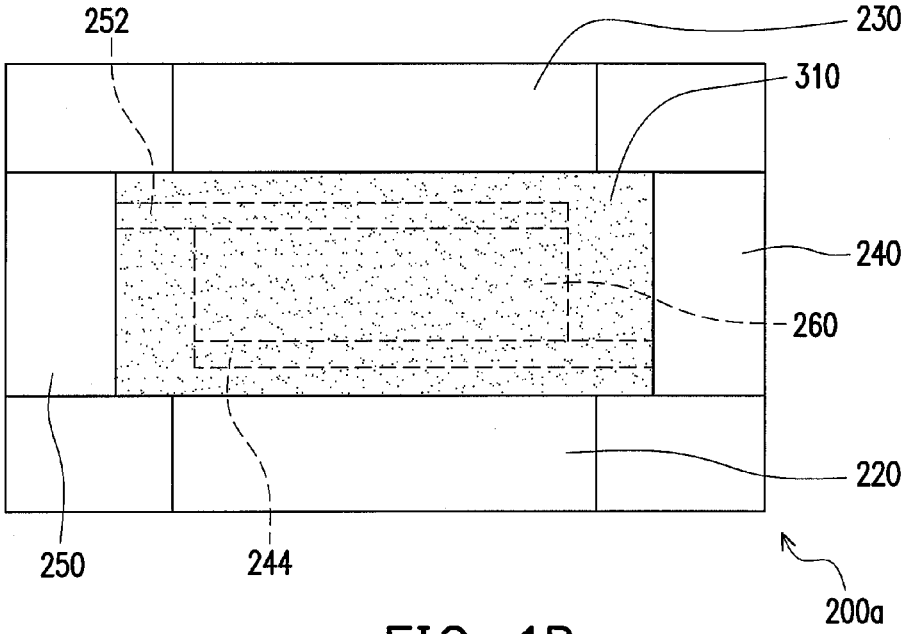
FIG. 1B is a schematic bottom view of a protective device of FIG. 1A.

Reference will now be made in detail to the present preferred embodiments of the invention, examples of which are illustrated in the accompanying drawings. Wherever possible, the same reference numbers are used in the drawings and the description to refer to the same or like parts.

Referring to FIGS. 1A-1D, in the present embodiment, the protective device 200*a* includes a substrate 210, a first electrode 220, a second electrode 230, a third electrode 240, a fourth electrode 250, a heat-generating element 260, a first auxiliary medium 270, a conductive section and at least one bridge element 290 (only one is schematically illustrated in FIGS. 1A-1D). The first electrode 220, the second electrode 230, the third electrode 240 and the fourth electrode 250 are respectively disposed on the substrate 210. Herein, the conductive section is supported by the substrate 210 and includes a metal element 280 electrically connected between the first electrode 210 and the second electrode 220.

In detail, in the present embodiment, the substrate 210 has a central portion C, a first peripheral portion 212, a second peripheral portion 214, a third peripheral portion 216, and a fourth peripheral portion 218 surrounding the central portion C. The first peripheral portion 212 is disposed corresponding to the second peripheral portion 214. The third peripheral portion 216 is disposed corresponding to the fourth peripheral portion 218. The first electrode 220, the second electrode 230, the third electrode 240 and the fourth electrode 250 are respectively disposed on the first peripheral portion 212, the second peripheral portion 214, the third peripheral portion 216 and the fourth peripheral portion 218. The substrate 210 has a first surface S1 and a second surface S2 opposite to the first surface S1, and the first electrode 220, the second electrode 230, the third electrode 240 and the fourth electrode 250 extend from the first surface S1 to the second surface S2, though the invention is not limited thereto, and allocation of each of the electrodes on the first surface S1 or the second surface S2 or existence of each of the electrodes is determined according to an actual design requirement. In another embodiment, the fourth electrode 250 can be disposed on the second surface S2 only. It should be noticed that in other embodiments, the fourth electrode 250 can also be omitted, which does not influence an over current and over voltage protection effect.

Furthermore, the third electrode 240 includes an intermediate support 242, a second extending portion 244 and a main body 246, wherein the intermediate support 242 and the second extending portion 244 may be respectively disposed on the first surface S1 and the second surface S2, and respectively extend to a location on the central portion C, and the intermediate support 242 is connected to the main body 246, for example. In the present embodiment, the intermediate support 242 and the second extending portion 244 are respectively disposed on two planes which are substantially parallel but do not overlap with each other. The intermediate support 242 is disposed between the metal element 280 and the substrate 210. A third extending portion 252 of the fourth electrode 250 is disposed on the second surface S2 and extends to a location on the central portion C. The intermediate support 242, the second extending portion 244, and the third extending portion 252 are respectively disposed between the first electrode 220 and the second electrode 230. In addition, here it should be noted that the forms of the intermediate support 242 are not limited in the invention, the intermediate support may be an independent part on the substrate without contact with the electrodes, and includes a material having a good thermal conductivity to facilitate breaking of the metal element upon melting.

A material of the substrate 210 includes ceramic (e.g. alumina), glass epoxy resin, zirconium oxide ($ZrO_2$), silicon nitride ($Si_3N_4$), aluminum nitride (AlN), boron nitride (BN), or other inorganic materials, for example. A material of the first electrode 220, the second electrode 230, the third electrode 240, and the fourth electrode 250 is, for example, silver, copper, gold, nickel, silver-platinum alloy, nickel alloy and other materials with good electrical conductivity.

Figure 1C:
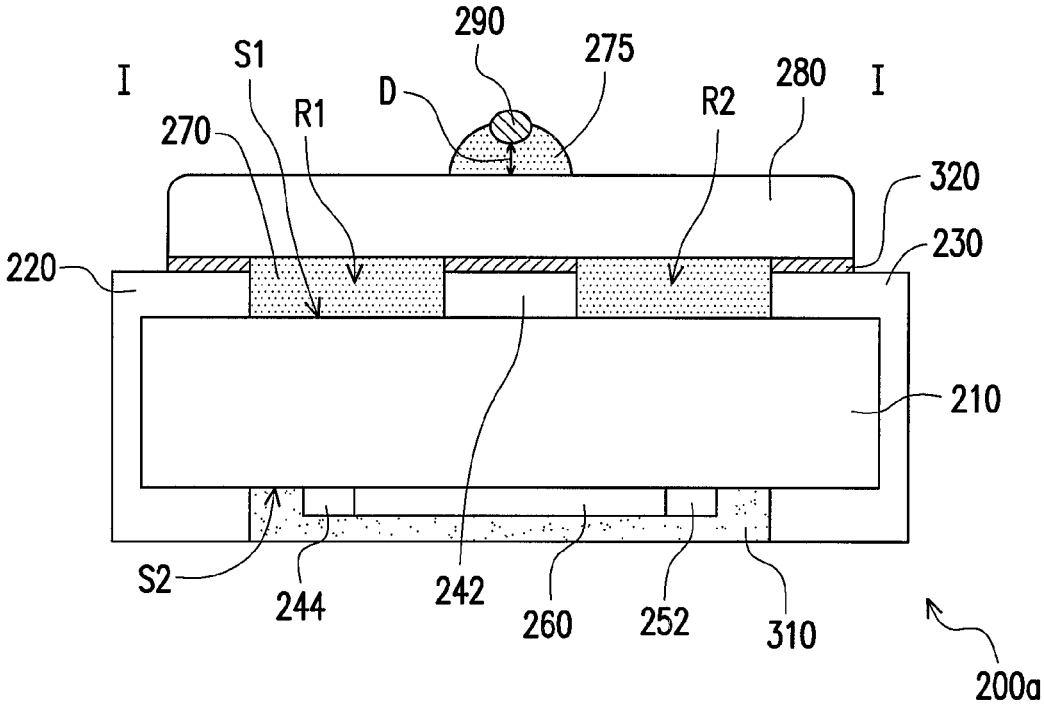
FIG. 1C is a schematic cross-sectional view of a protective device of FIG. 1A along a sectional line I-I.
Figure 1D:
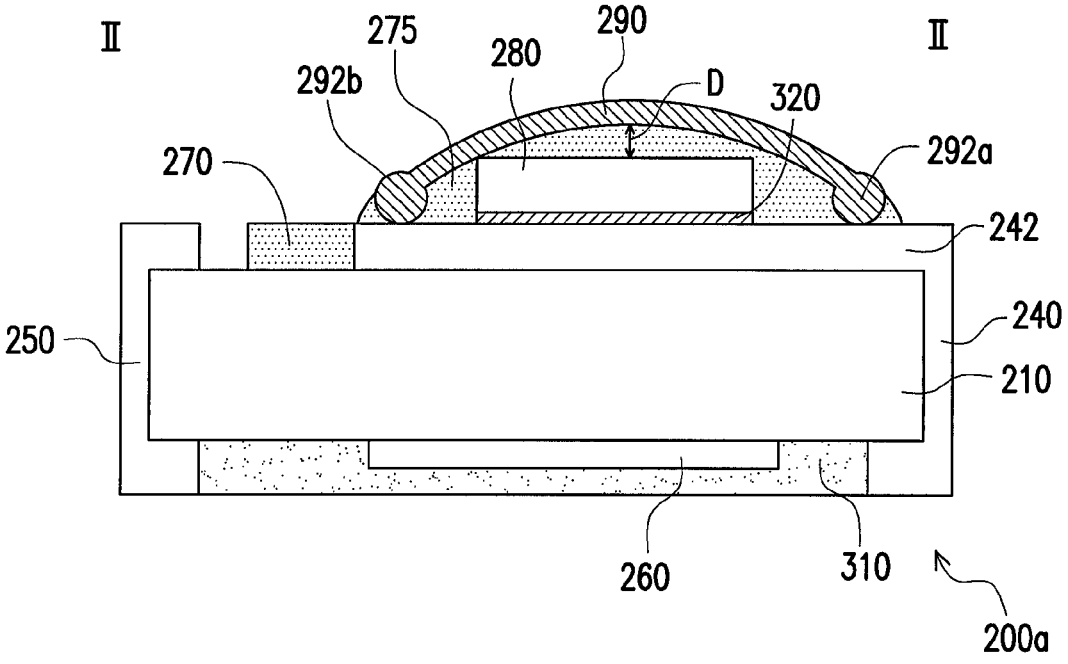
FIG. 1D is a schematic cross-sectional view of a protective device of FIG. 1A along a sectional line II-II.

The heat-generating element 260 is disposed on the second surface S2 and is connected between the second extending portion 244 and the third extending portion 252, wherein the intermediate support 242 of the third electrode 240 is disposed over the heat-generating element 260 (as shown by FIG. 1C). A material of the heat-generating element 260 includes ruthenium dioxide ($RuO_2$), carbon black (the carbon black can be doped in an inorganic adhesive such as water glass or in an organic adhesive such as thermal curable resin), copper, titanium, nickel-chromium alloy, and nickel-copper alloy, for example. Moreover, in order to protect the heat-generating element 260 from being affected by subsequent manufacturing process and humidity, acidity and alkalinity of the ambient environment, the heat-generating element 260 is covered by an insulating layer 310 made of frit glue or epoxy resin.

The first auxiliary medium 270 is disposed on the first surface S1 of the substrate 210 and is located between the intermediate support 242 and the first electrode 220, and between the intermediate support 242 and the second electrode 230. In detail, the first auxiliary medium 270 is filled in a first trench R1 formed by the first electrode 220, the intermediate support 242 and the substrate 210, and is filled in a second trench R2 formed by the second electrode 230, the intermediate support 242, and the substrate 210. In the present embodiment, the first auxiliary medium 270 is made of rosin, softener, active agent and synthetic rubber.

The metal element 280 is disposed over the first surface S1 of the substrate 210, and is connected to the first electrode 220, the intermediate support 242 and the second electrode 230. In detail, the metal element 280 serves as a sacrificial structure having a melting point lower than that of the first electrode 220 and the second electrode 230. The metal element 280 covers a portion of the first electrode 220, the first auxiliary medium 270, the intermediate support 242 and the second electrode 230. When the heat-generating element 260 generates heat to melt the first auxiliary medium 270 and the metal element 280, a melting effect of the metal element 280 is improved. Moreover, the first auxiliary medium 270 can also increase the wettability between the melted metal element 280 and each of the electrodes, and enhance a cohesive force of the melted metal element 280 itself, such that the melted metal element 280 can flow and congregate on each of the electrodes, so as to effectively blow the metal element 280. In addition, a material of the metal element 280 includes tin-lead alloy, tin-silver-lead alloy, tin-indium-bismuth-lead alloy, tin-antimony alloy, tin-silver-copper alloy, and other alloy with a low melting point. Moreover, in other embodiments, a flux (not shown) can be embedded in the metal element 280, so as to help blowing the metal element 280 by heat. It should be noted that although the present invention is described by using a protective device having the heat-generating element to simultaneously achieve the over voltage protection and the over current protection, those skilled in the art should know that the feature of disposing the first auxiliary medium 270 below the metal element 280 to facilitate the stability of effectively blowing the metal element 280 can also be applied to a structure having no heat-generating element to facilitate the stability of blowing the metal element 280 when an over current occurs to cause the metal element 280 to be melted by heat.

The protective device 200*a* includes the bridge element 290, wherein the bridge element 290 spans across the metal element 280 in a direction across direction of current flow in the metal element 280, and partially contacts the metal element 280, and the bridge element 290 has a first end 292*a* and a second end 292*b* opposite to the first end 292*a*. Particularly, the first end 292*a* of the bridge element 290 is fixed on the main body 246 of the third electrode 240, though the invention is not limited thereto, and the first end 292*a* of the bridge element 290 can also be fixed on the intermediate support 242 of the third electrode 240 at a side where the intermediate support 242 is connected to the main body 246. To achieve a better performance of the bridge element 290, preferably, the second end 292*b* of the bridge element 290 is fixed to the intermediate support 242 of the third electrode 240 at a side apart from the main body 246. Namely, the first end 292*a* and the second end 292*b* of the bridge element 290 are respectively fixed on the main body 246 and the intermediate support 242 of the third electrode 240, and the bridge element 290 has an elongated structure, for example, is an arch as that shown in FIG. 1D. Particularly, an orthographic projection of the bridge element 290 on the first surface S1 of the substrate 210 is at least partially overlapped to an orthographic projection of the intermediate support 242 on the first surface S1 of the substrate 210. Furthermore, the bridge element 290 facilitates breaking of the metal element 280 upon melting.

Figure 2A:
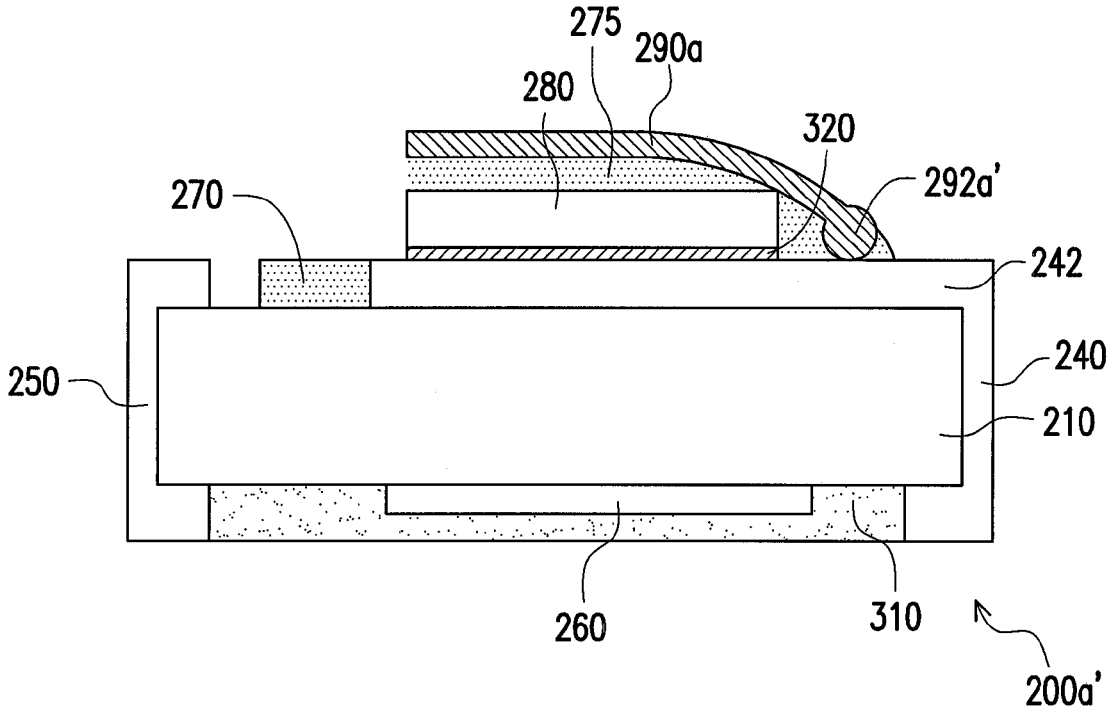
FIG. 2A is cross-sectional view of a protective device according to another embodiment of the invention.
Figure 2B:
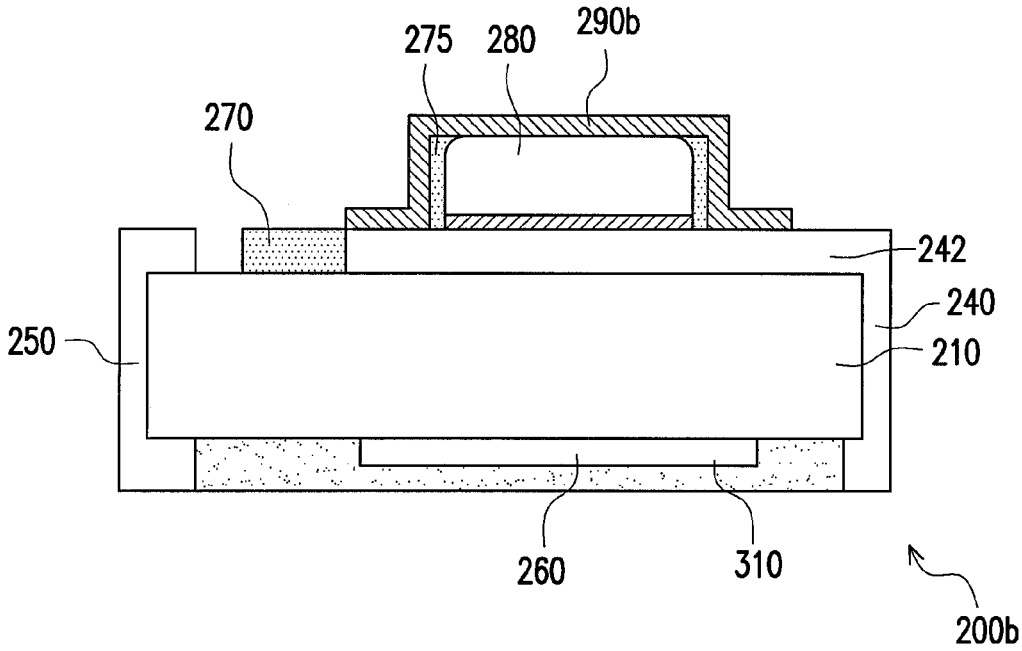
FIG. 2B is cross-sectional view of a protective device according to another embodiment of the invention.

It should be noticed that a shape, a number and a pattern of the bridge element 290 are not limited by the invention. Although the bridge element 290 of the present embodiment has an elongated structure, for example an arch, and is particularly a metal wire, in other embodiment, referring to FIG. 2A, only the first end 292*a* of the bridge element 290*a* of the protective device 200*a*' is fixed on the intermediate support 242 of the third electrode 240, i.e. the bridge element 290*a* has an elongated structure, for example an arc shape. Alternatively, referring to FIG. 2B, the bridge element 290*b* of the protective device 200*b* can also have an elongated structure, a bending shape, for example, a hat shape or other suitable shapes. Alternatively, the protective device 200*a* may have two or more bridge elements 290, or the bridge element 290 can be formed by curling a plurality of twisted wires (not shown), or the bridge element 290 can be in the form of chain, coils, gauze, wire having changing thickness along length or wires having protrusions at different locations along length, or the bridge element 290 that are rigid, flexible, solid, hollow; or the bridge element 290 has U-shape or C-shape or E-shape cross-section, and other cross section geometries, which are all considered to be within the scope of the invention.

In the present embodiment, since the bridge element 290 partially contacts the metal element 280, and an interval D is formed between a highest point of the bridge element 290 and a surface of the metal element 280 that is apart from the substrate 210, wherein the interval D is smaller than or equal to 0.25 mm, which is preferably between 0 mm and 0.1 mm, a second auxiliary medium 275 can be configured between the bridge element 290 and the metal element 280 to serve as a medium to guide flowing of the melted metal element 280. Besides the material of the first auxiliary medium 270 such as rosin can be used, the material of the second auxiliary medium 275 can also be a solder layer or a combination thereof. In other words, the materials of the first auxiliary medium 270 and the second auxiliary medium 275 can be the same or different according to an actual design requirement. Moreover, junctions between the first end 292*a* of the bridge element 290 and the main body 246 of the third electrode 240, and between the second end 292*b* of the bridge element 290 and the intermediate support 242 of the third electrode 240 can also be coated with the second auxiliary medium 270, so as to avoid oxidation of the first end 292*a* and the second end 292*b* of the bridge element 290, and strengthen a structure strength of the bridge element 290.

Since the protective device 200*a* of the embodiment has the bridge element 290, when the heat-generating element 260 generates heat to melt the metal element 280, the melted metal element 280 is adhered to the contacted bridge element 290 due to surface tension and a wicking phenomenon, and can further flow towards the intermediate support 242, so as to cut off the circuit to achieve the over voltage protection and the over current protection. Namely, due to the absorption of the bridge element 290, the melted metal element 280 is not liable to conduct the intermediate support 242 and the first electrode 220 or the intermediate support 242 and the second electrode 230, so as to prevent short-circuiting of the protective device 200*a*, and accordingly achieve a high reliability of the protective device 200*a*.

Figure 2C:
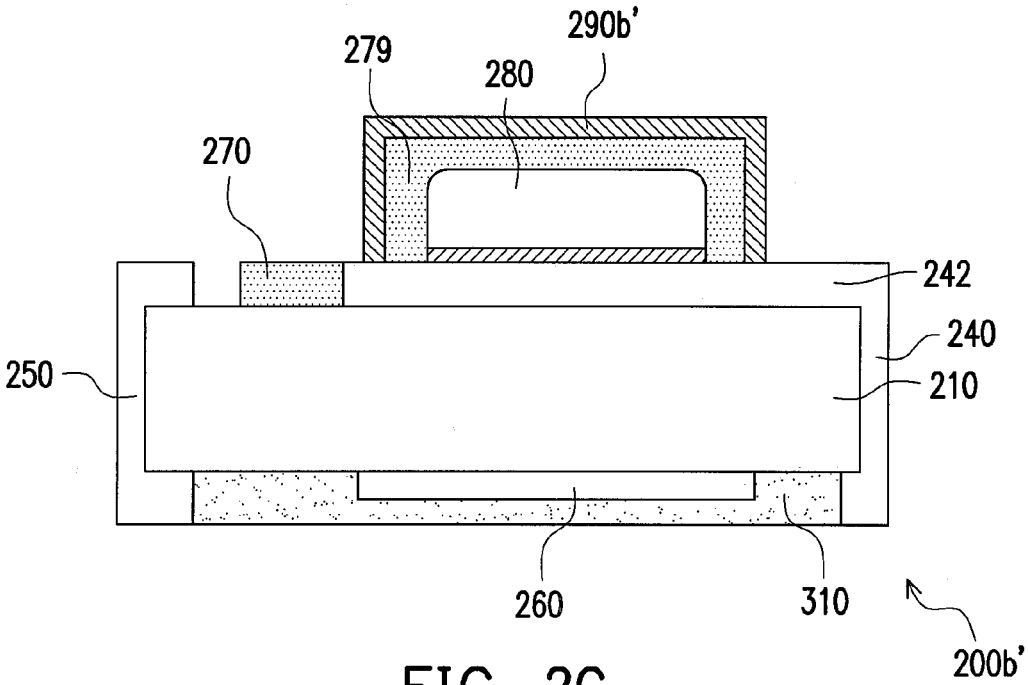
FIG. 2C is cross-sectional view of a protective device according to another embodiment of the invention.

It should be noticed that in other embodiments, referring to FIG. 2C, the bridge device 290*b*' does not contact the metal element 280. In detail, in the embodiment of FIG. 2C, a shape of the bridge device 290*b*' is, for example, a reversed U-shape, wherein the bridge device 290*b*' does not contact the metal element 280, and an auxiliary medium 279 is disposed between the bridge element 290*b*' and the metal element 280. In the present embodiment, the auxiliary medium 279 is, for example, a flux or a solder layer. When the heat-generating element 260 generate heat to melt the metal element 280, the melted metal element 280 is adhered to the bridge element 290*b*' through the auxiliary medium 279 due to surface tension and a wicking phenomenon, so as to cut off the circuit to achieve the over voltage protection and the over current protection.

Moreover, since the metal element 280 is only melted at a region and peripheral thereof where orthographic projections of the metal element 280 and the bridge element 290 on the first surface S1 of the substrate 210 are mutually overlapped, the second auxiliary medium 275 is only required to be disposed between the metal element 280 and the bridge element 290 to help the melted metal element fixed flowed through the bridge element 290. In this way, overall coating of the second auxiliary medium 275 on the surface of the metal element 280 is unnecessary, so that a usage amount of the second auxiliary medium 275 is reduced, so as to reduce a fabrication cost. On the other hand, since a melting amount of the metal element 280 is reduced, the driving time for the protective device 200*a* in over voltage protection is shortened, and a short-circuiting phenomenon caused by the melted metal element 280 electrically connecting the intermediate support 242 and the first electrode 220 or the intermediate support 242 and the second electrode 230 is also mitigated. Thereby, reliability of the protective device 200*a* is enhanced.

Moreover, in the present embodiment, a material of the bridge element 290 is, for example, a single metal, a double-layer metal or an alloy, wherein the single metal is, for example, gold, silver, tin, nickel, aluminium or copper, the double-layer metal is, for example, formed by silver, gold or tin-coated copper, and the alloy is, for example, copper silver alloy, copper nickel alloy, nickel tin alloy or copper nickel tin alloy, though the invention is not limited thereto. It should be noticed that an outer surface of the bridge element 290 preferably have good wettability and absorbability (for example, solderability) for the melted metal element 280, so that the bridge element 290 can also be formed by an outer metal layer with a good solderability and an inner metal layer with a good thermal conductivity, for example, materials such as silver-plated copper, nickel-plated copper, tin-plated copper, tin-plated nickel, and gold-plated copper, etc. Since the material of the bridge element 290 is metal or alloy, the bridge element 290 may have a heat-dissipation function, so as to improve a heat-dissipation effect of the protective device 200*a*.

Moreover, in the present embodiment, the protective device 200*a* further includes a intermediate layer 320 disposed on the first electrode 220, the second electrode 230 and the extending portion 242, so as to fix the metal element 280 on the first electrode 220, the second electrode 230, and the intermediate support 242, though the invention is not limited thereto, and the metal element 280 can also be fixed through other known soldering technique without using the intermediate layer 320. In more detail, the intermediate layer 320 is disposed between the metal element 280 and the intermediate support 242, which the intermediate layer 320 including a first solder material has a fusing temperature lower than the melting temperature of the metal element 280. In the present embodiment, a material of the intermediate layer 320 includes solder materials such as tin silver alloy and tin lead alloy, etc.

Moreover, since the melted intermediate layer 320 has a good wettability, when the metal element 280 is blown, the melted metal congregates on the melted intermediate layer 320, and the melted metal element 280 is adhered to the contacted bridge element 290 due to surface tension and the wicking phenomenon, and further flows towards the intermediate support 242, so as to prevent the melted metal from causing a short-circuiting phenomenon of the intermediate support 242 and the first electrode 220 or the second electrode 230. In this way, effectively blowing the metal element 280 to prevent the over voltage and the over current can be further ensured.

A manufacturing method of the protective device 200*a* is described in detail as follows. FIGS. 3A-3D are top views illustrating steps for manufacturing the protective device according to an embodiment of the invention. It should be noted that, the elements in FIGS. 1A to 1D, which are named and labelled identically to those in FIGS. 3A to 3D, have the materials similar thereto. Therefore, the detailed descriptions are not repeated herein. For simplicity's sake, manufacturing steps on the second surface S2 of the substrate 210 are omitted, and only manufacturing steps on the first surface S1 of the substrate 210 are illustrated in FIGS. 3A-3D.

Figure 3A:
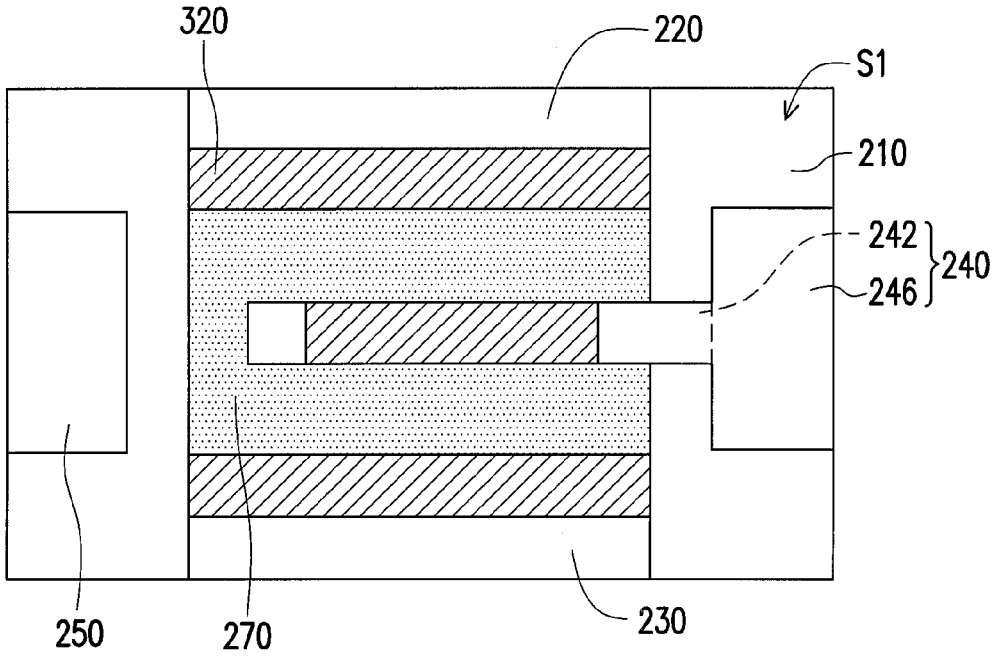
FIGS. 3A-3D are top views illustrating steps for manufacturing a protective device according to an embodiment of the invention.

First, referring to FIG. 3A, a substrate 210 is provided, and a first electrode 220, a second electrode 230, a third electrode 240, and a fourth electrode 250 are formed on the substrate 210. The substrate 210 has a first surface S1 and a second surface S2 opposite thereto, and the first electrode 220, the second electrode 230, the third electrode 240, and the fourth electrode 250 are extended from the first surface S1 to the second surface S2. In the present embodiment, an intermediate support 242 and a second extending portion 244 of the third electrode 240 are respectively disposed on the first surface S1 and the second surface S2, and a main body 246 of the third electrode 240 is connected to the intermediate support 242. A third extending portion 252 of the fourth electrode 250 is disposed on the second surface S2. The first ending portion 242, the second extending portion 244, and the third extending portion 252 are respectively disposed between the first electrode 220 and the second electrode 230.

Then, referring to FIG. 3A again, an intermediate layer 320 is formed, for example, by coating on the first electrode 220, the second electrode 230, and the intermediate support 242. After that, a first auxiliary medium 270 is formed, for example, by coating on the substrate 210 among the first electrode 220, the second electrode 230, and the intermediate support 242. In other embodiments, when a material of the intermediate layer 320 includes a solder alloy and 10-15% of an auxiliary medium material for example, a method of forming the first auxiliary medium 270 includes heating the intermediate layer 320 (e.g. over 120° C.), so that the auxiliary medium material is softened and flows to the substrate 210 among the first electrode 220, the second electrode 230, and the intermediate support 242. If the auxiliary medium material is of insufficient amount, a second auxiliary medium (not shown) can be selectively added.

Figure 3B:
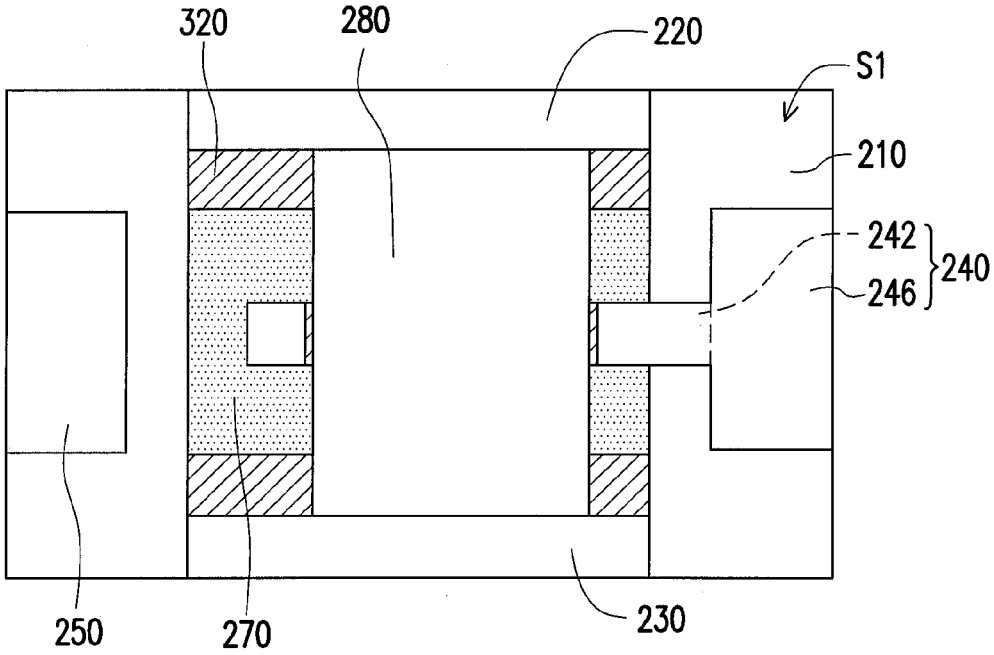

Then, referring to FIG. 3B, a metal element 280 is disposed on the first electrode 220, the second electrode 230, and the intermediate support 242, and the metal element 280 and the intermediate layer 320 are soldered together, so that the first auxiliary medium 270 is sandwiched between the metal element 280 and the substrate 210. Thereby, when the heat-generating element 260 below the substrate 210 generates heat, the first auxiliary medium 270 over the substrate 210 helps melting the metal element 280 disposed over the first auxiliary medium 270.

Figure 3C:
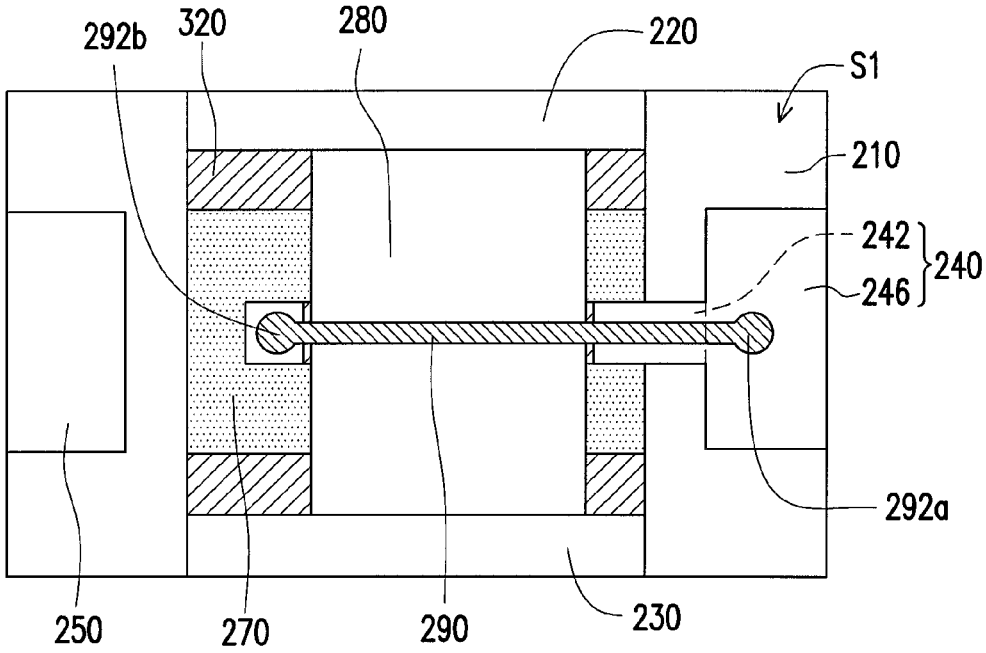

Then, referring to FIG. 3C, a spot welder (not shown) is used to perform a welding process to a bridge element 290, so as to respectively fix a first end 292*a* and a second end 292*b* of the bridge element 290 on the main body 246 and the intermediate support 242 of the third electrode 240. Wherein, a welding method thereof can be an arc welding, an ultrasonic welding, a laser welding, a hot welding, or melting welding, etc. Certainly, in other embodiments that are not illustrated, a stud bump machine can be used to form a bump (i.e. to form the first end 292*a* of the bridge element 290) on the main body 246 of the third electrode 240, and the bonding wire is extended upwards for a certain distance, and then after the bonding wire is drawn downwards to the intermediate support 242 of the third electrode 240 (i.e. to form the second end 292*b* of the bridge element 290), the stitch is withdrawn to form the bridge element 290.

Figure 3D:
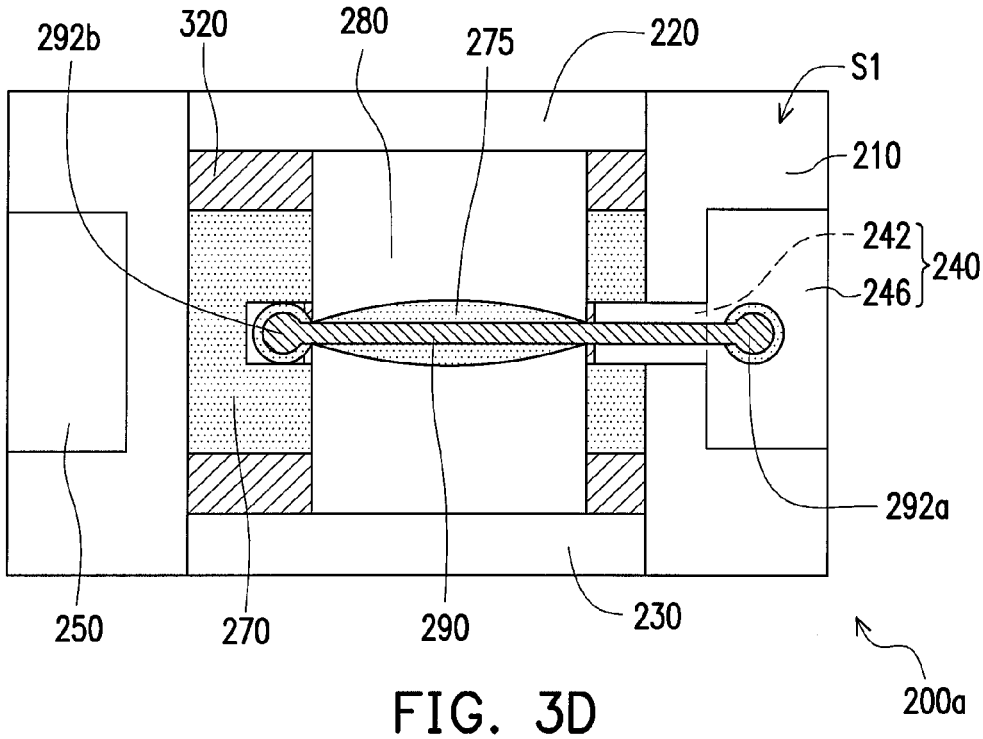

Finally, referring to FIG. 3D, a second auxiliary medium 275 is filled between the metal element 280 and the bridge element 290, between the first end 292*a* of the bridge element 290 and the main body 246 of the third electrode 240, and between the second end 292*b* of the bridge element 290 and the intermediate support 242 of the third electrode 240, and is heated (over 140° C.) for about 30 minutes and cooled for about 5 minutes to complete the manufacturing steps of the protective device 200*a* on the first surface S1 of the substrate 210.

Figure 4A:
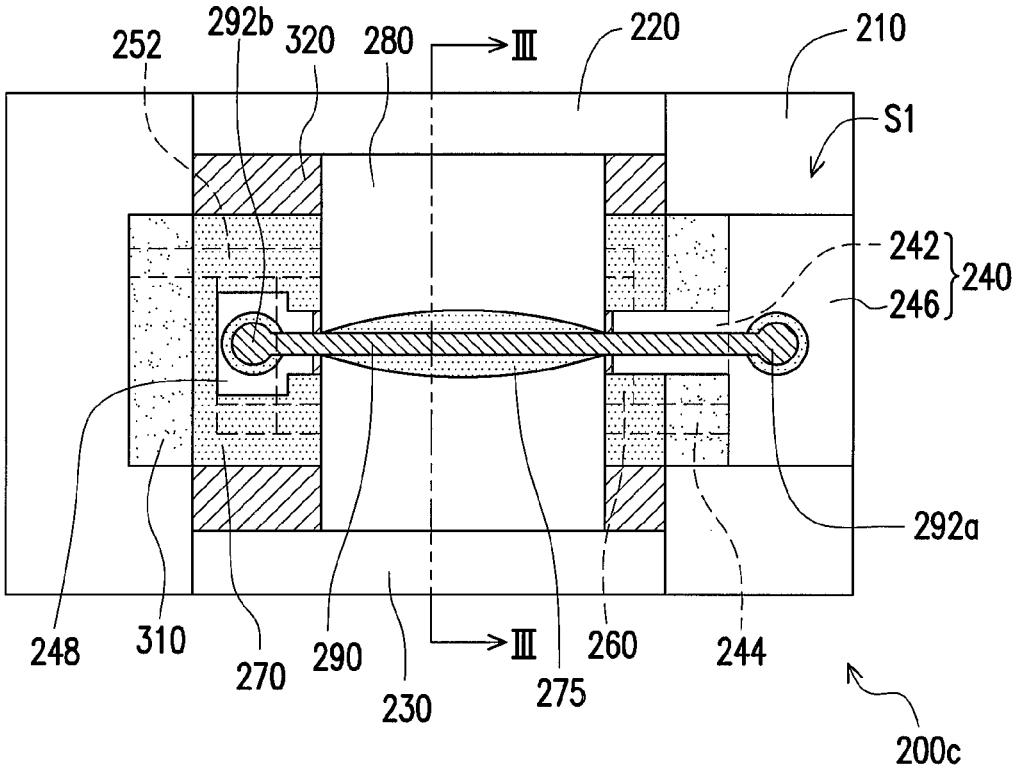
FIG. 4A is a schematic top view of a protective device according to another embodiment of the invention.
Figure 4B:
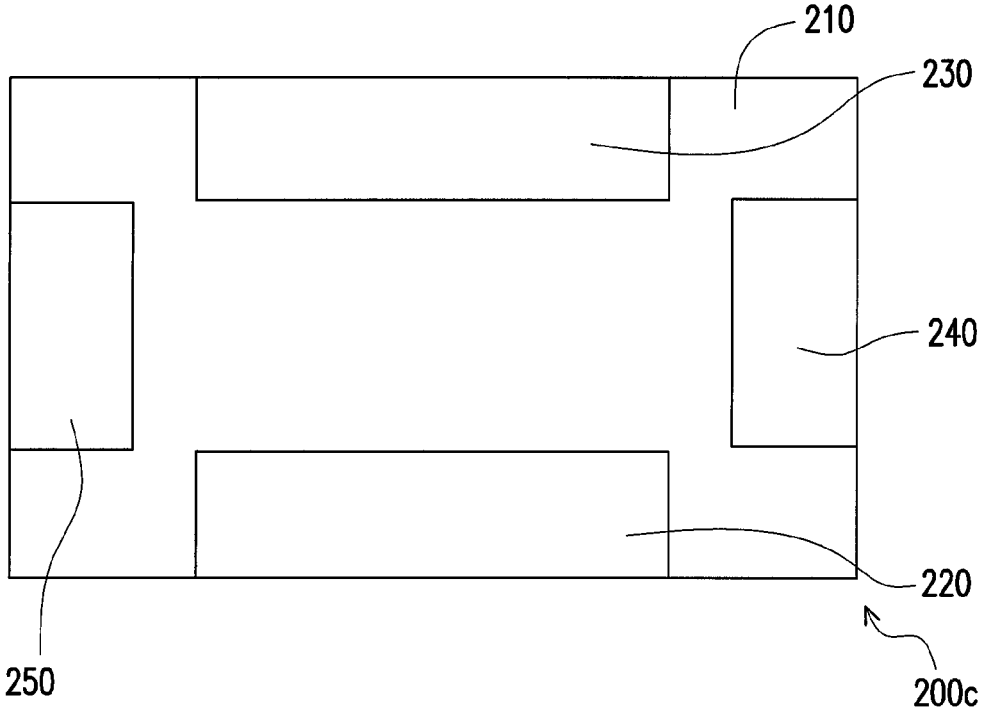
FIG. 4B is a schematic bottom view of a protective device of FIG. 4A.
Figure 4C:
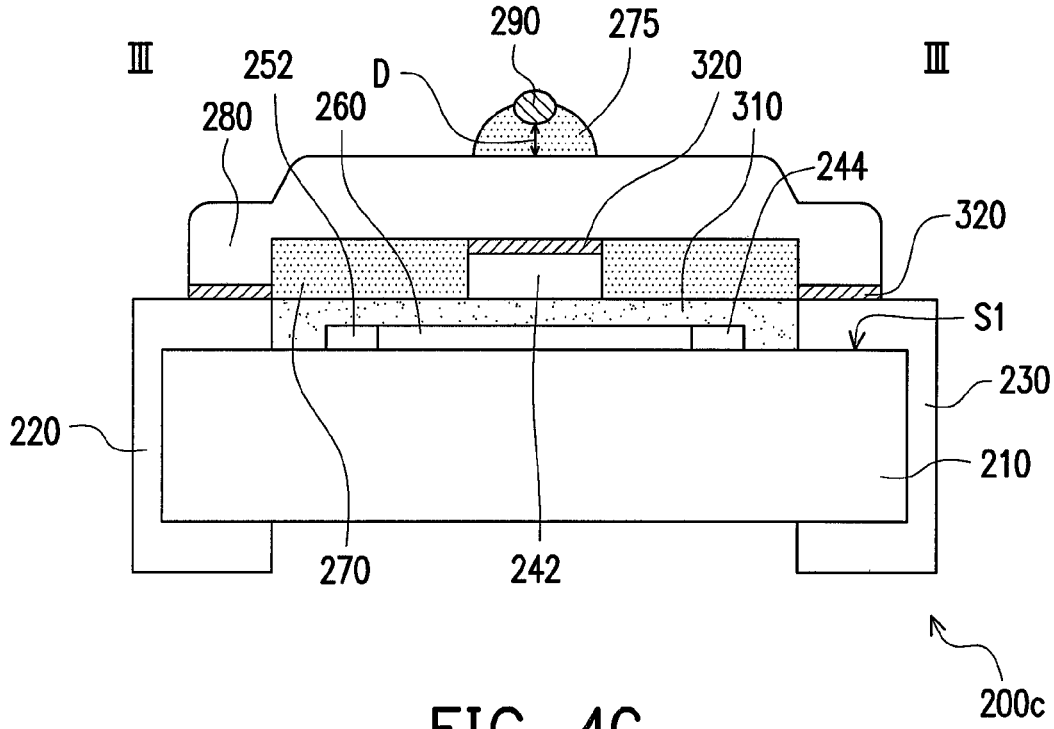
FIG. 4C is a schematic cross-sectional view of a protective device of FIG. 4A along a sectional line III-III.

FIG. 4A is a schematic top view of a protective device according to another embodiment of the invention. FIG. 4B is a schematic bottom view of the protective device of FIG. 4A. FIG. 4C is a schematic cross-sectional view of the protective device of FIG. 4A along a sectional line Referring to FIGS. 4A-4C, the protective device 200*c* of the present embodiment is similar to the protective device 200*a* of FIGS. 1A-1D, and a main difference there between is that the heat-generating element 260, the second extending portion 244 and the third extending portion 252 of the protective device 200*c* of FIGS. 4A-4C are all disposed on the first surface S1 of the substrate 210.

In detail, the third electrode 240 further has a bonding portion 248, wherein the bonding portion 248 is connected to the intermediate support 242, and the second end 292*b* of the bridge element 290 is fixed on the bonding portion 248. The second extending portion 244 and the third extending portion 252 are disposed on the first surface S1 and located between the first electrode 220 and the second electrode 230. The heat-generating element 260 is disposed between the second extending portion 244 and the third extending portion 252. The insulating layer 310 covers the heat-generating element 260, the second extending portion 244 and the third extending portion 252. The intermediate support 242 of the third electrode 240 extends to a location on the insulating layer 310. The first auxiliary medium 270 is disposed on the insulating layer 310 and is located around the intermediate support 242, i.e. the first auxiliary medium 270 is disposed between the intermediate support 242 and the first electrode 220 and between the intermediate support 242 and the second electrode 230. The metal element 280 covers the first electrode 220, the first auxiliary medium 270, the intermediate support 242, and the second electrode 230, so that the first auxiliary medium 270 is disposed between the metal element 280 and the insulating layer 310. In this way, when the heat-generating element 260 generates heat, the heat is conducted to the first auxiliary medium 270 and the metal element 280 through the insulating layer 310, so as to melt the metal element 280. Moreover, by using the first auxiliary medium 270, a surface oxidation layer generated on the metal element 280 under a normal current operation can be reduced or removed, so as to increase reliability of quickly melting the metal element 280. In the present embodiment, the intermediate support 242 and the second extending portion 244 are respectively disposed on two planes which are substantially parallel but do not overlap with each other.

Figure 5:
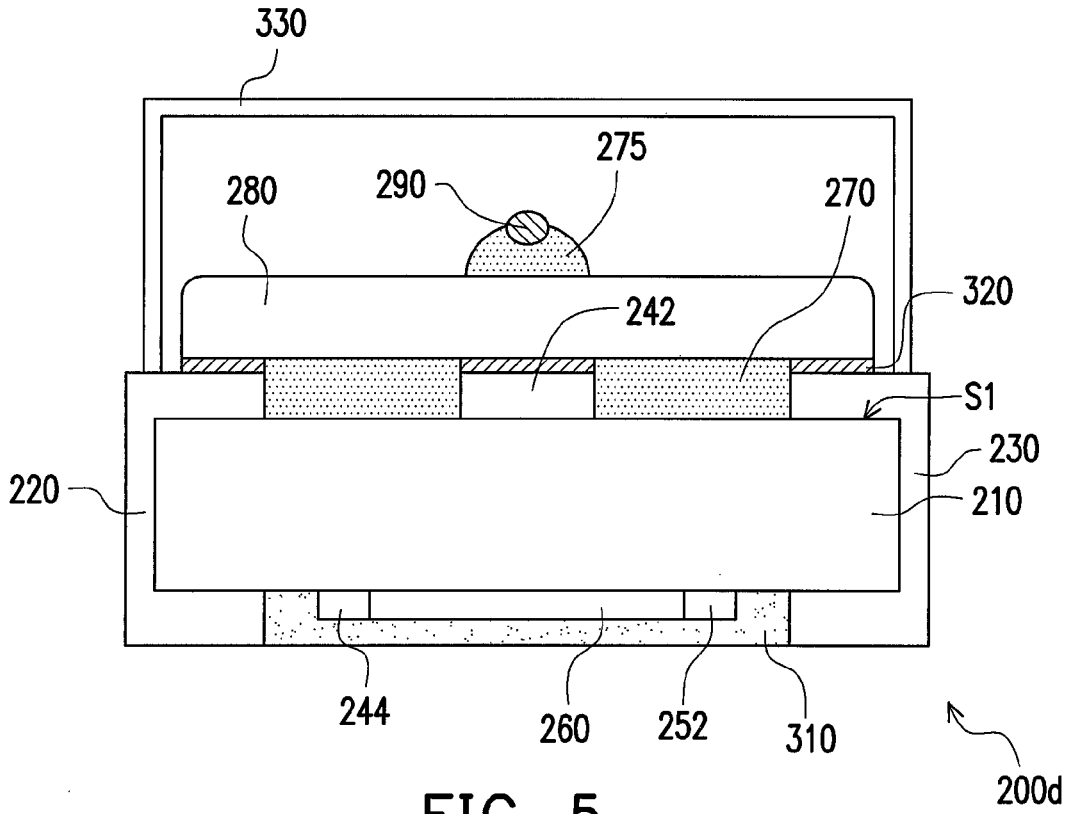
FIG. 5 is a schematic cross-sectional view of a protective device according to another embodiment of the invention.

FIG. 5 is a schematic cross-sectional view of a protective device according to another embodiment of the invention. Referring to FIG. 5, the protective device 200*d* of the present embodiment is similar to the protective device 200*a* of FIGS. 1A-1D, and a main difference there between is that the protective device 200*d* of FIG. 5 includes a housing 330. In detail, the housing 330 is disposed on the first surface S1 of the substrate 210, and covers the metal element 280 for protecting the metal element 280, so as to prevent problems such as circuit interference caused by spilling of the melted metal element 280, the first auxiliary medium 270, and the intermediate layer 320. Moreover, a material of the housing 330 includes aluminium oxide, PEEK, nylon, thermoplastic resin, UV curing resin or phenol formaldehyde resin, etc.

Figure 6A:
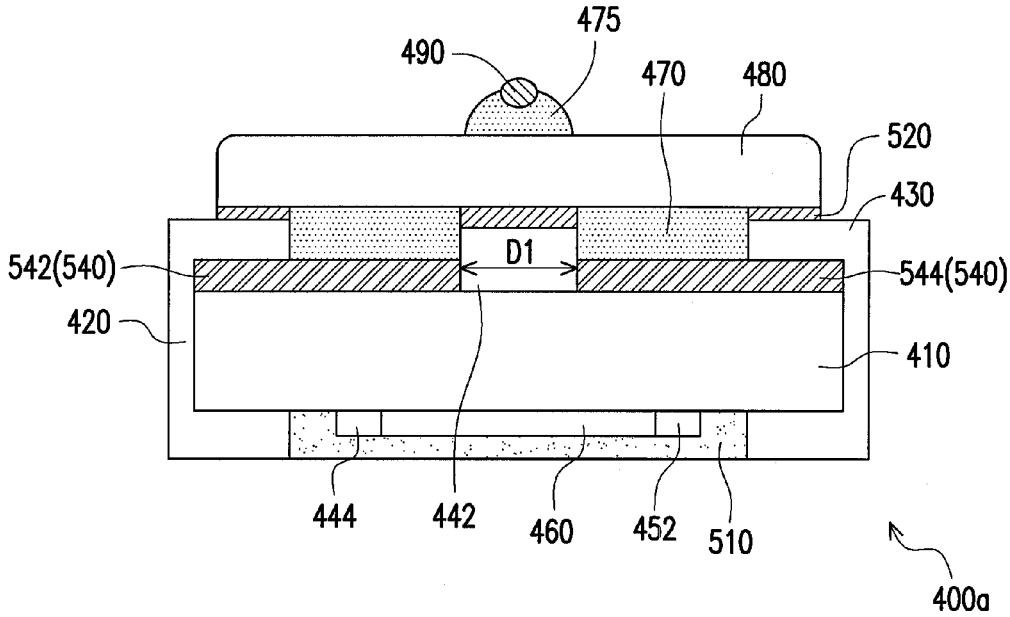
FIG. 6A is a schematic cross-sectional view of a protective device according to an embodiment of the invention.
Figure 6B:
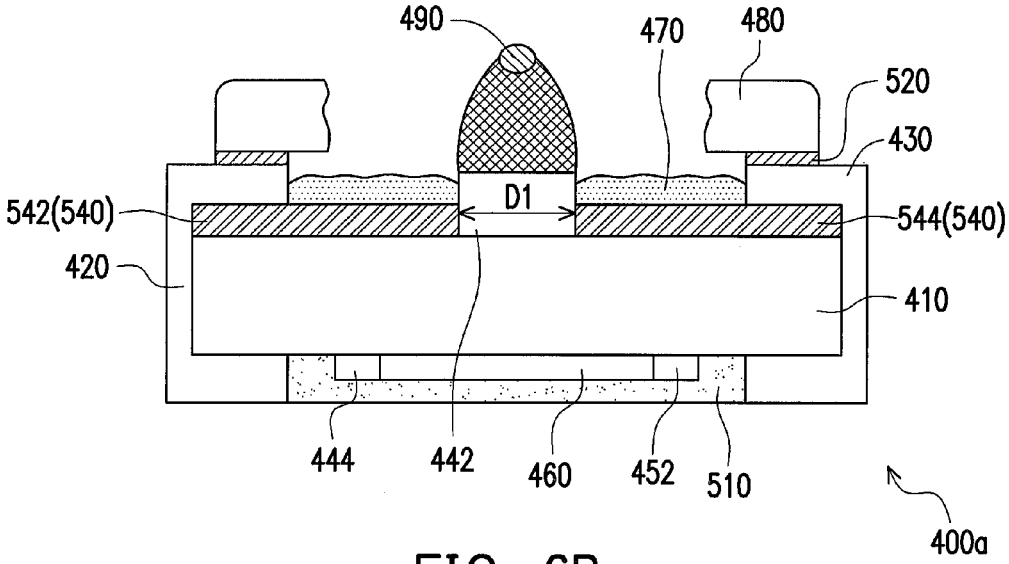
FIG. 6B is a schematic cross-sectional view of the protective device in FIG. 6A after breaking.

FIG. 6A is a schematic cross-sectional view of a protective device according to an embodiment of the invention. FIG. 6B is a schematic cross-sectional view of the protective device in FIG. 6A after breaking. In the present embodiment, a protective device 400*a* of FIG. 6A is similar to the protective device 200*a* of FIGS. 1A-1D, and a main difference there between is that the protective device 400*a* of FIG. 6A further includes a heat insulation portion, such as a first insulating layer 540, disposed between the heat-generating element 460 and the first electrode 420 and the second electrode 430. Herein, the heat transfer to the intermediate support 442 is at a higher rate than that to the first electrode 420 and the second electrode 430.

In detail, the first insulating layer 540 of the protective device 400*a* is disposed on the first surface S1 of the substrate 410, and has a first low thermal conductive portion 542 and a second low thermal conductive portion 544 separated from the first low thermal conductive portion 542 by the intermediate support 442 of the third electrode 440. Particularly, the first low thermal conductive portion 542 is located between the heat-generating element 460 and the first electrode 420, and the second low thermal conductive portion 544 is located between the heat-generating element 460 and the second electrode 430. Specifically, the first low thermal conductive portion 542 is located between the substrate 410 and the first electrode 420, and the second low thermal conductive portion 544 is located between the substrate 410 and the second electrode 430. A first space D1 exists between the first low thermal conductive portion 542 and the second low thermal conductive portion 544, and the intermediate support 442 of the third electrode 440 is disposed in the first space D1 on the substrate 410. In addition, a material of the first insulating layer 540 is, for example, a glass material or a polymer material, and a thermal conductivity coefficient of the first insulating layer 540 is smaller than that of the substrate 410, preferably, the thermal conductivity coefficient of the first insulating layer 540 is smaller than 2 W/(m·K) and the thermal conductively coefficient of the substrate 410 is between 8 W/(m·K) and 80 W/(m·K). For example, the glass material having a thermal conductivity coefficient between 1 W/(m·K) and 1.5 W/(m·K) can be $SiO_2$, $Na_2O_3$, $B_2O_3$, MgO, or CaO, etc. The polymer material has relatively low thermal conductivity coefficient, which is, for example, polyurethane (PU), polyimide, epoxy resin or UV curing resin, wherein a thermal conductivity coefficient of the epoxy resin is between 0.19 W/(m·K) and 0.6 W/(m·K).

Particularly, the thermal conductivity coefficient of the substrate 410 is greater than that of the first insulating layer 540. That is, relative to the first insulating layer 540, the substrate 410 is regarded as a high thermal conductive layer, so that the heat generated by the heat-generating element 460 can directly pass through the central portion of the substrate 410 and be quickly transferred to the intermediate support 442. Certainly, the substrate 410 and the first insulating layer 540 can be made of the same material, namely, the substrate 410 can also be regarded as a low thermal conductive layer. However, a sum of a thickness of the substrate 410 and a thickness of the first insulating layer 540 is substantially greater than the thickness of the substrate 410. Therefore, the heat generated by the heat-generating element 460 can directly pass through the central portion of the substrate 410 and be quickly transferred to the intermediate support 442. In other word, the material of the substrate 410 can be selected according to practical requirements without influencing the efficacy of the present embodiment. Moreover, the first auxiliary medium 470 at least covers a portion of the first insulating layer 540.

The protective device 400*a* in the present embodiment has the first insulting layer 540. Hence, when the heat-generating element 460 generates heat and transfers the heat to the electrode through the substrate 410, a portion of the heat generated by the heat-generating element 460 is obstructed by the first insulating layer 540 on the substrate 410 so as to reduce the heat obtained by the first electrode 420 and the second electrode 430, and the other portion of the heat generated by the heat-generating element 460 is directly transferred to the metal element 480 via the third electrode 440 so as to blow the metal element 480 located over the third electrode 440. Namely, since the first electrode 420 and the second electrode 430 are obstructed by the low thermal conductive insulating layer, the metal element 480 located over the first electrode 420 and the second electrode 430 is not easy to be blown compared to the metal element 480 located over the third electrode 440, i.e. the melting amount of the metal element 480 can be reduced. Therefore, the heat generated by the heat-generating element 460 can be regarded to be concentratively transferred to the third electrode 440. In other words, the metal element 480 located on the intermediate support 442 of the third electrode 440 will be fused and fixed between the bridge element 490 and the intermediate support 442 before the metal element 480 located on the first and second electrodes 420, 430 will be fused, as shown in FIG. 6B. The melted metal element 480 is mixed with the melted intermediate layer 520, the melted second auxiliary medium 475 and a portion of the first auxiliary medium 470 as a melted material, such that the melted material could flow along the bridge element 490 due to surface tension and a wicking action (may or may not include capillary action), so as to cut off the circuit to achieve the over voltage protection and the over current protection. In this way, an adhesive area of the melted metal element 480 can be effectively controlled to obtain the stable melt time and mode, and the alignment error between the heat-generating element 460 and the third electrode 440 generated during the fabrication process can be reduced, i.e. the metal element 480 located over the third electrode 440 is ensured to be first blown, so as to cut off the circuit and achieve the over voltage protection or the over current protection.

In other aspect, since the melting amount of the metal element 480 is reduced, the driving time for the protective device 400*a* in over voltage protection is reduced, and the short-circuiting phenomenon caused by the melted metal element 480 electrically connecting the intermediate support 442 and the first electrode 420 or the intermediate support 442 and the second electrode 430 is also mitigated. Thereby, reliability of the protective device 400*a* is also enhanced.

Moreover, since the intermediate support 442 is disposed in the first space D1 existing between the low thermal conductive portion 542 and the second low thermal conductive portion 544, the first auxiliary medium 470 can be effectively guided to the peripheral of the intermediate support 442. Therefore, the intermediate support 442 may have a better wetting effect to ensure stability of the melt time for melting the metal element 480. Moreover, since the protective device 400*a* has the first insulating layer 540, when a size of the protective device 400*a* is reduced in order to match a small-size electronic product, the intermediate support 442 of the third electrode 440 can also provide a corresponding electrode area, so as to ensure a quick blow of the metal element 480. In this way, besides that an application range of the protective device 400*a* is expanded, and reliability of the protective device 400*a* is also enhanced.

Figure 7:
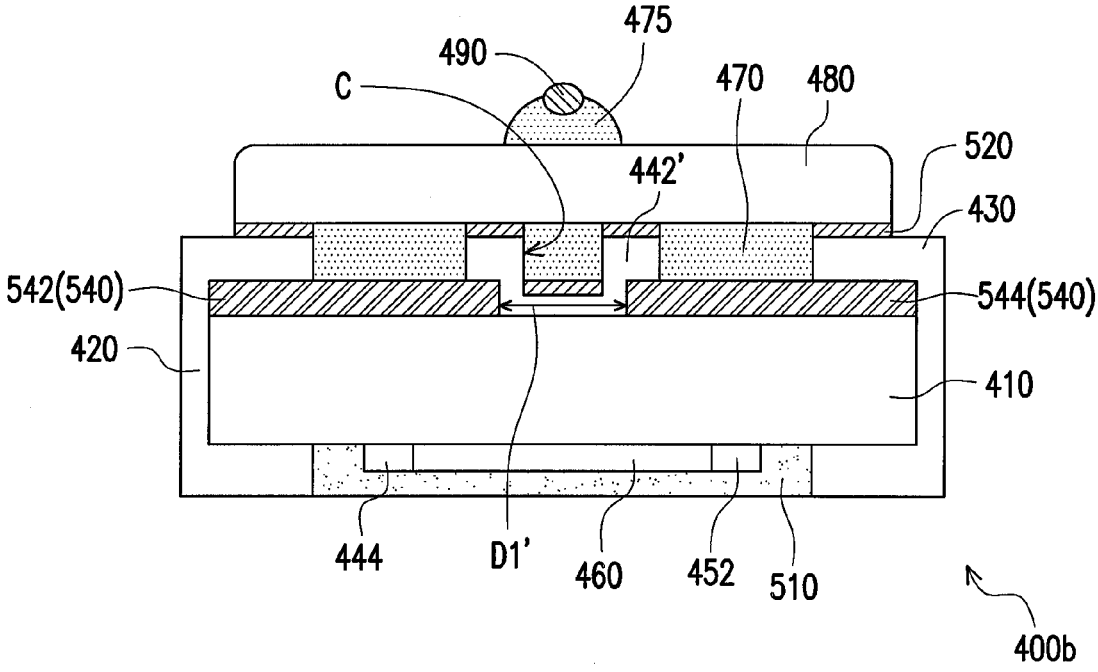
FIG. 7 is a schematic cross-sectional view of a protective device according to another embodiment of the invention.

FIG. 7 is a schematic cross-sectional view of a protective device according to another embodiment of the invention. A protective device 400*b* of FIG. 7 is similar to the protective device 400*a* of FIG. 6A, and a main difference there between is that an electrode design of the protective device 400*b* of FIG. 7 is different to that of the protective device 400*a*.

In detail, a portion of the intermediate support 442' of the third electrode 440' is located in the first space D1', and the other portion of the intermediate support 442' is located on the first low thermal conductive portion 542 and the second low thermal conductive portion 544 of the first insulating layer 540. Specifically, in the present embodiment, since a value of the first space D1' is greater than that of the first space D1, a notch structure C is produced in the intermediate support 442' due to the gravity during fabricating the electrode. Namely, the intermediate support 442' has the notch structure C located in the first space D1', so that the third electrode 440' forms a three-dimensional structure in the same space. In this way, the adhesive area of the melted metal element 480 can be increased. Moreover, the first auxiliary medium 470 can also be filled in the notch structure C so that the intermediate support 442' has a better absorption ability for adsorbing the melted metal element 480.

Figure 8:
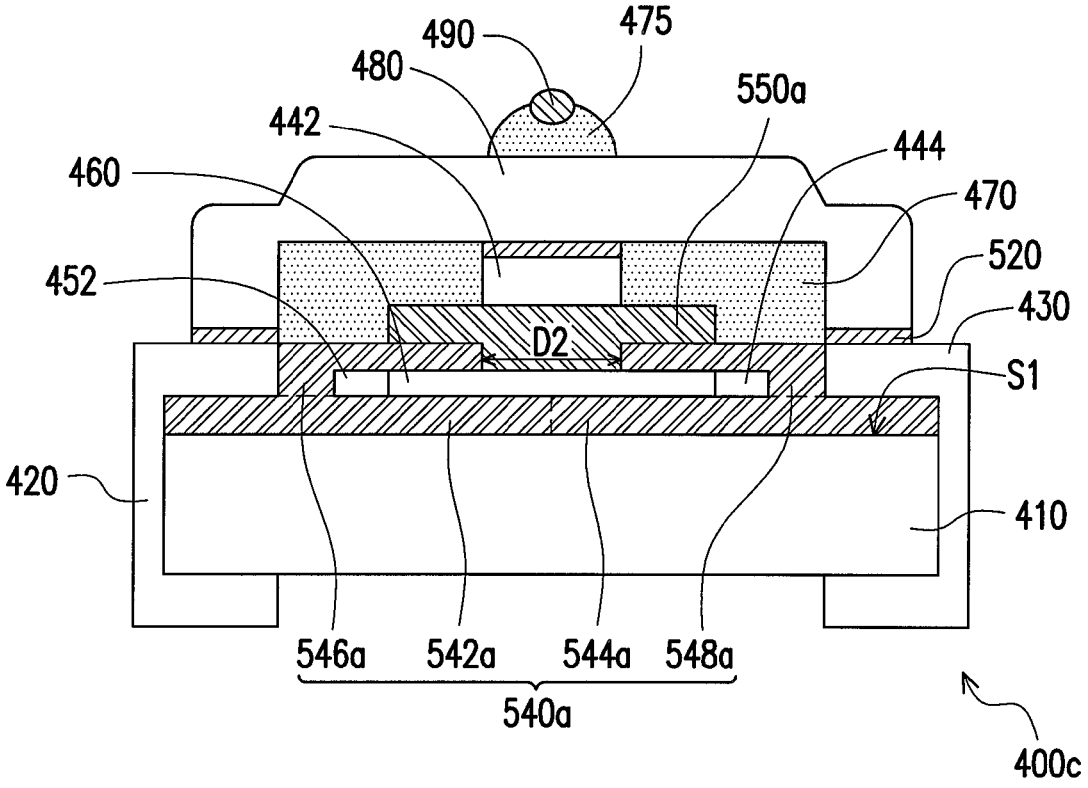
FIG. 8 is a schematic cross-sectional view of a protective device according to another embodiment of the invention.

FIG. 8 is a schematic cross-sectional view of a protective device according to another embodiment of the invention. A protective device 400*c* of FIG. 8 is similar to the protective device 400*a* of FIG. 6, and a main difference there between is that in the protective device 400*c* of FIG. 8, the heat-generating element 460, the second extending portion 444, and the third extending portion 452 are all disposed on the first surface S1 of the substrate 410, and the protective device 400*c* further includes a second insulating layer 550*a*. Herein, a thermal conductivity coefficient of the second insulating layer 550*a* is greater than that of the first insulating layer 540*a*.

In detail, the second insulating 550*a* of the protective device 400*c* in the present embodiment is disposed between the heat-generating element 460 and the intermediate support 442 of the third electrode 440. Herein, the first low thermal conductive portion 542*a* connects the second low thermal conductive portion 544*a*, and the heat-generating element 460 is located between the second insulating layer 550*a* and the first insulating layer 540*a*. Specifically, the first insulating layer 540*a* in the present embodiment further includes a third low thermal conductive portion 546*a* and a fourth low thermal conductive portion 548*a*, wherein the third low thermal conductive portion 546*a* connects the first low thermal conductive portion 542*a* and extends to the third extending portion 452, and the fourth low thermal conductive portion 548*a* connects the second low thermal conductive portion 544*a* and extends to the second extending portion 444. In the present embodiment, a second space D2 exists between the third low thermal conductive portion 546*a* and the fourth low thermal conductive portion 548*a*, and a portion of the second insulating layer 550*a* is disposed in the second space D2, and the other portion of the second insulating layer 550*a* is located on the third low thermal conductive portion 546*a* and the fourth low thermal conductive portion 548*a*. In addition, in order to transfer most of the heat generated by the heat-generating element 460 to the intermediate support 442, preferably, a thermal conductivity coefficient of the second insulating layer 550*a* is greater than a multiple of 8 of that of the first insulating layer 540*a*. For example, a material of the second insulating layer 550*a* can be a ceramic material, for example, $Al_2O_3$, BN, AlN, wherein a thermal conductivity coefficient of $Al_2O_3$ is between 28 W/(m·K) and 40 W/(m·K), a thermal conductivity coefficient of BN is between 50 W/(m·K) and 60 W/(m·K), and a thermal conductivity coefficient of AlN is between 160 W/(m·K) and 230 W/(m·K). Preferably, a thermal conductivity coefficient of the second insulting layer 550*a* is between 8 W/(m·K) and 80 W/(m·K).

Since the second insulating layer 550*a* of the protective device 400*c* is located between the intermediate support 442 and the heat-generating element 460, when the heat-generating element 460 generates heat, a greater part of the heat generated by the heat-generating element 460 is directly transferred to the intermediate support 442, so that the metal element 480 located on the intermediate support 442 can be quickly blown, so as to reduce the melting amount of the metal element 480, and cut off the circuit to effectively achieve the over voltage protection or the over current protection. On the other hand, since the melting amount of the metal element 480 is reduced, the driving time for the protective device 400*a* in over voltage protection is shortened, and a short-circuiting phenomenon caused by the melted metal element 480 electrically connecting the intermediate support 442 and the first electrode 420 or the intermediate support 442 and the second electrode 430 is also mitigated. Thereby, reliability of the protective device 400*c* is also enhanced.

Moreover, since the protective device 400*c* simultaneously has the first insulating layer 540*a* and the second insulating layer 550*a*, when a size of the protective device 400*c* is reduced in order to match a small-size electronic product, the intermediate support 442 of the third electrode 440 can also provide a corresponding electrode area, so as to ensure a quick blow of the metal element 480. In this way, besides that an application range of the protective device 400*c* is expanded, and reliability of the protective device 400*c* is also enhanced.

Figure 9:
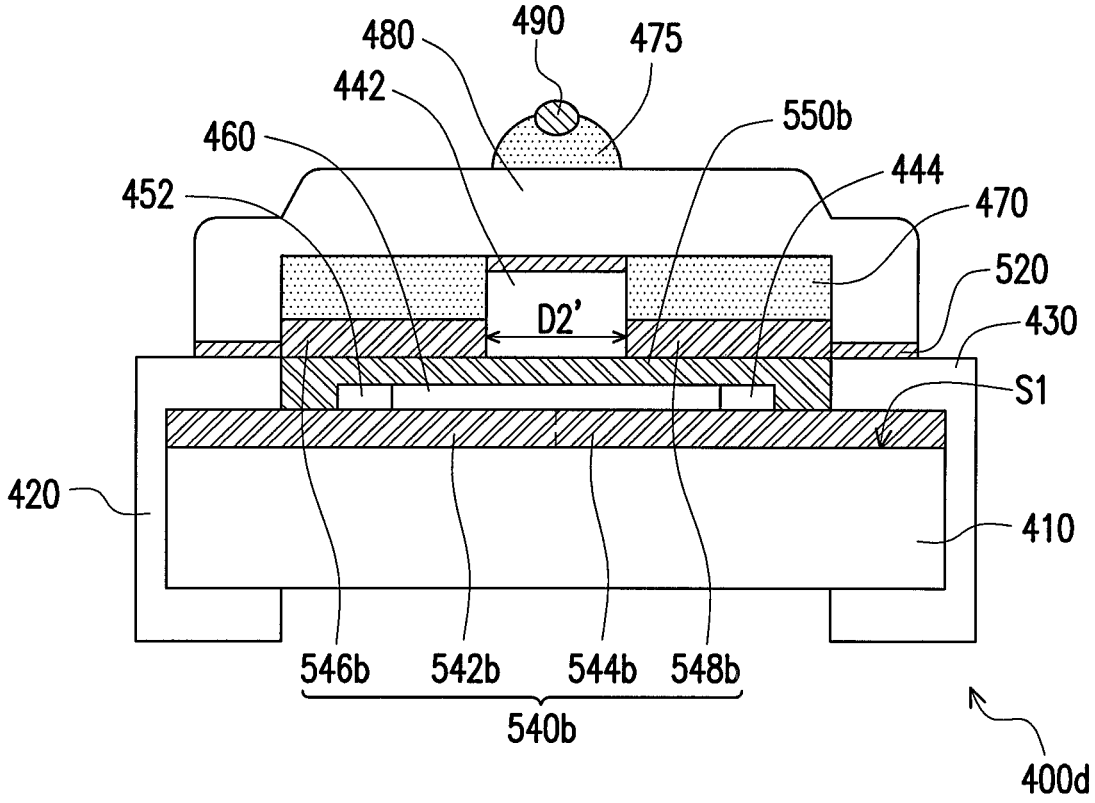
FIG. 9 is a schematic cross-sectional view of a protective device according to another embodiment of the invention.

FIG. 9 is a cross-sectional view of a protective device according to another embodiment of the invention. A protective device 400*d* of FIG. 9 is similar to the protective device 400*c* of FIG. 8, and a main difference there between is that disposing positions of the first insulating layer 540*b* and the second insulting layer 550*b* of the protective device 400*d* of FIG. 9 are different to that of the first insulating layer 540*a* and the second insulting layer 550*a* of the protective device 400*c* of FIG. 8.

In detail, the third low thermal conductive portion 546*b* and the fourth low thermal conductive portion 548*b* are disposed on the second insulating layer 550*b*, a second space D2' exists between the third low thermal conductive portion 546*b* and the fourth low thermal conductive portion 548*b*, and the intermediate support 442 of the third electrode 440 is disposed in the second space D2'. Since the protective device 400*d* of the present embodiment simultaneously has the first insulating layer 540*b* and the second insulating layer 550*b*, when the heat-generating element 460 generates heat, a portion of the heat generated by the heat-generating element 460 is obstructed by the third low thermal conductive portion 546*b* and the fourth low thermal conductive portion 548*b*, thereby the heat amount transferred to the metal element 480 located over the third low thermal conductive portion 546*b* and the fourth low thermal conductive portion 548*b* can be reduced. In other aspect, the other portion of the heat generated by the heat-generating element 460 is directly transferred to the metal element 480 via the second insulating layer 550*b* and the intermediate support 442 so as to blow the metal element 480 located over the intermediate support 442. Consequently, the melting amount of the metal element 480 can be reduced so as to reduce the driving time for the protective device 400*d* in over voltage protection, and over voltage protection or an over current protection can be achieved at the same time.

Figure 10:
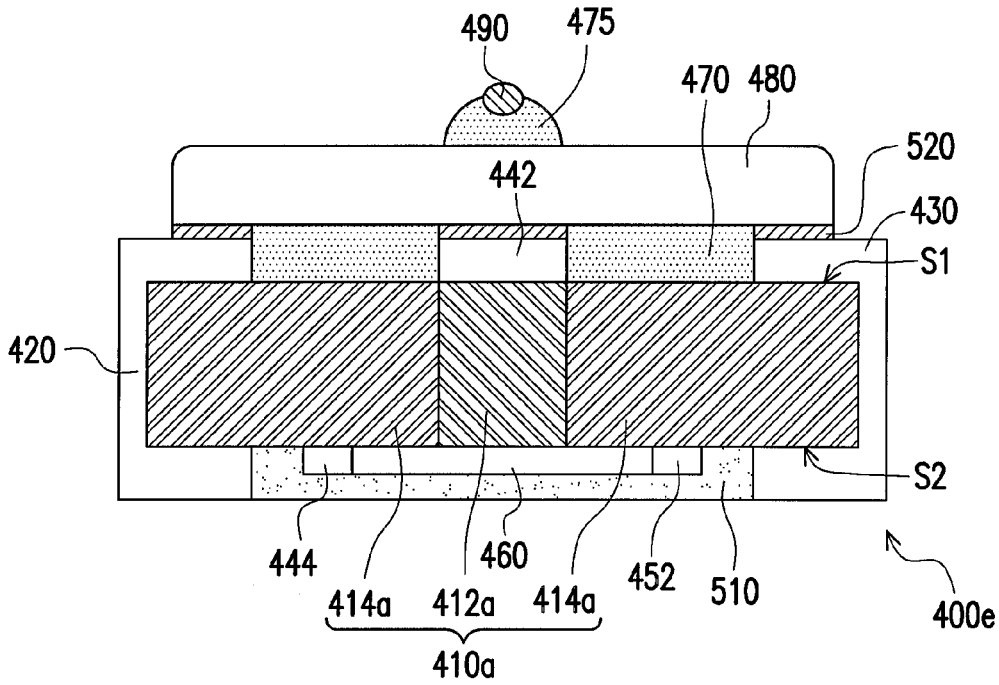
FIG. 10 is a schematic cross-sectional view of a protective device according to another embodiment of the invention.

FIG. 10 is a schematic cross-sectional view of a protective device according to another embodiment of the invention. A protective device 400*e* of FIG. 10 is similar to the protective device 400*a* of FIG. 6, and a difference there between is that a design of the substrate 410*a* of the protective device 400*e* of FIG. 10 is changed to achieve a performance of the first insulating layer 540 of FIG. 6.

In detail, the substrate 410*a* of the present embodiment has a first insulating block 412*a* and a second insulating block 414*a* connected to the first insulating block 412*a*. Herein, the second insulating block 414*a* surrounds the first insulating block 412*a*, and the first insulating block 412*a* and the second insulating block 414*a* are substantially co-planar. The intermediate support 442 of the third electrode 440 is located on the first insulating block 412*a*, and the first electrode 420 and the second electrode 430 are located on the second insulating block 414*a*. The first auxiliary medium 470 is disposed on the first surface S1 of the substrate 410*a* and located between the intermediate support 442 of the third electrode 440 and the first electrode 420 and between the intermediate support 442 of the third electrode 440 and the second electrode 430.

Herein, the first auxiliary medium 470 covers a portion of the second insulating block 414*a*. Particularly, a thermal conductivity coefficient of the first insulating bock 412*a* is greater than that of the second insulating block 414*a*.

Specifically, in the present embodiment, a material of the first insulating block 412*a* is, for example, a ceramic material. The ceramic material is, for example, $Al_2O_3$, BN, or AlN. Preferably, the thermal conductivity coefficient of first insulating block 412*a* is between 8 W/(m·K) and 40 W/(m·K). In other aspect, a material of the second insulating block 414*a* is, for example, a glass material or a polymer material. For instance, the glass material can be $SiO_2$, $Na_2O_3$, $B_2O_3$, MgO, CaO, etc., and the polymer material can be polyurethane (PU), polyimide, epoxy or UV curing resin. Preferably, the thermal conductivity coefficient of the second insulating block 414*a* is smaller than 2 W/(m·K).

Since the heat-generating element 460 is located on the first insulating bock 412*a*, when the heat-generating element 460 generates heat, a greater part of the heat generated by the heat-generating element 460 is directly transferred to the intermediate support 442, so that the metal element 480 located on the intermediate support 442 can be quickly blown and adhered to the bridge element 490, so as to reduce the melting amount of the metal element 480, and cut off the circuit to achieve the over voltage protection or the over current protection. On the other hand, since the melting amount of the metal element 480 is reduced, the driving time for the protective device 400*e* in over voltage protection is shortened, and a short-circuiting phenomenon caused by the melted metal element 480 electrically connecting the intermediate support 442 and the first electrode 420 or the intermediate support 442 and the second electrode 430 is also mitigated. Thereby, reliability of the protective device 400*e* is also enhanced.

Figure 11:
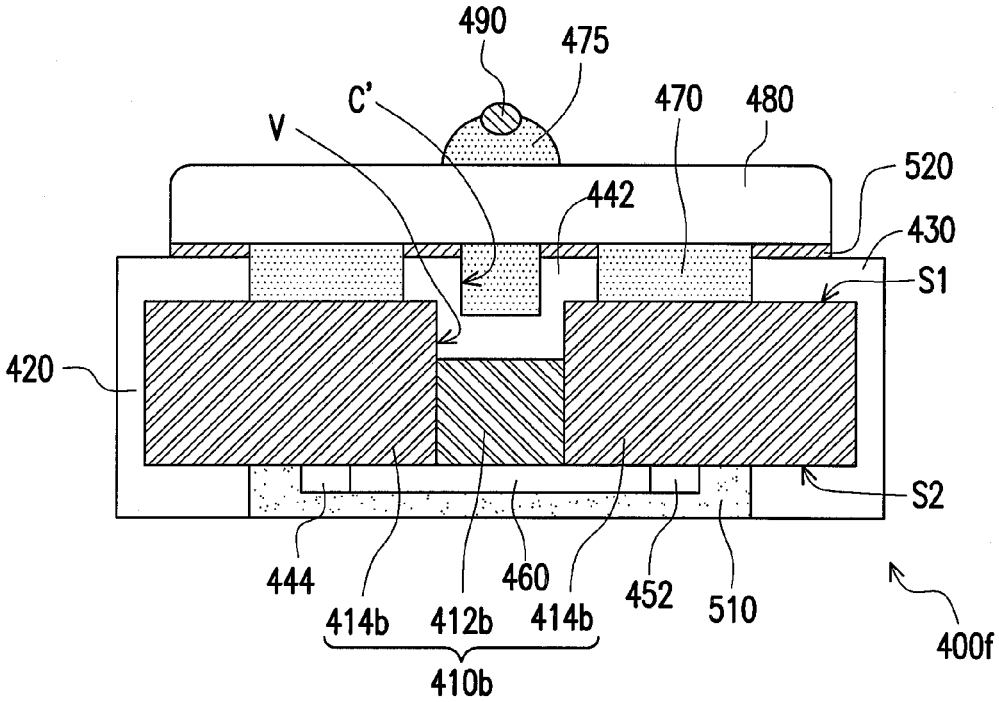
FIG. 11 is a schematic cross-sectional view of a protective device according to still another embodiment of the invention.

FIG. 11 is a schematic cross-sectional view of a protective device according to still another embodiment of the invention. A protective device 400*f* of FIG. 11 is similar to the protective device 400*e* of FIG. 10 except that the first insulating block 412*b* and the second insulating block 414*b* of the substrate 410*b* of the protective device 400*f* of FIG. 11 are not co-planar substantially.

In detail, the thickness of the first insulting bock 412*b* is lower than that of the second insulating block 414*b*, so that a notch V is existed between the first insulating bock 412*b* and the second insulating block 414*b*. In the present embodiment, a portion of the intermediate support 442 is disposed in the notch V and located on the first insulating block 412*b*, and the other portion of the intermediate support 442 is disposed on the second insulating block 414*b*. Specifically, in the present embodiment, since the notch V exists between the first insulating block 412*b* and the second insulating block 414*b*, during a fabrication process of the electrode, a notch structure C' is produced in the intermediate support 442 due to the gravity. Therefore, the third electrode 440 forms a three-dimensional structure in the same space, and the adhesive area of the melted metal element 480 can be increased. Moreover, the first auxiliary medium 470 can also be filled in the notch structure C', so that the intermediate support 442 may have better absorption ability for adsorbing the melted metal element 480. Moreover, the melted metal device 480 may have a wicking phenomenon (may or may not include capillary action) due to the notch structure C', which avails blowing the metal element 480, so as to cut off the circuit to achieve the over voltage protection or the over current protection.

Figure 12:
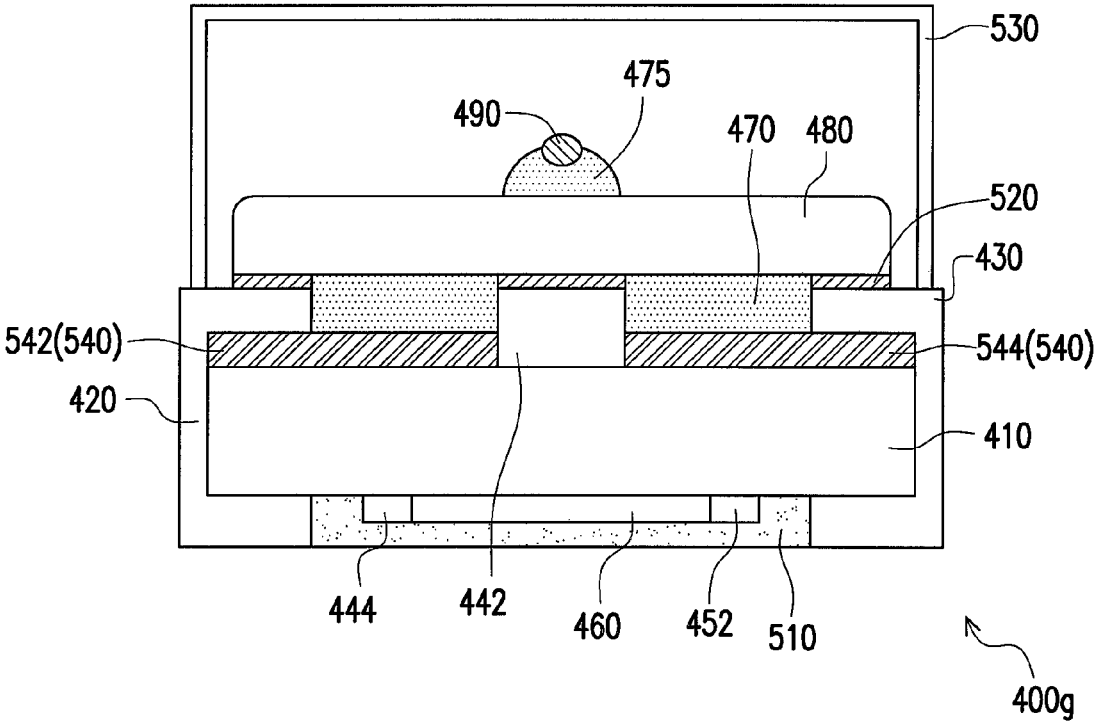
FIG. 12 is a schematic cross-sectional view of a protective device according to yet another embodiment of the invention.

FIG. 12 is a schematic cross-sectional view of a protective device according to yet another embodiment of the invention. Referring to FIG. 12, a protective device 400*g* of FIG. 12 is similar to the protective device 400*a* of FIG. 6, and a main difference there between is that the protective device 400*g* of FIG. 12 includes a housing 530. In detail, the housing 530 is disposed on the first surface S1 of the substrate 410, covers the metal element 480 to protect the metal element 480, and prevents problems such as circuit interference caused by spilling of the melted metal element 480, the first auxiliary medium 470, and the intermediate layer 520. In addition, a material of the housing 530 includes, for example, alumina, polyetheretherketone (PEEK), nylon, thermal-curing resin, UV-curing resin, or phenol formaldehyde resin.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A protective device, comprising:

a substrate;

a conductive section supported by the substrate, wherein the conductive section comprises a metal element electrically connected between first and second electrodes, wherein the metal element serves as a sacrificial structure having a melting point lower than that of the first and second electrodes;

a bridge element spanning across the metal element in a first direction across a direction of current flow in the metal element, wherein the bridge element extends in the first direction farther than the metal element in the first direction and facilitates breaking of the metal element upon melting, wherein the bridge element is made of metal;

an intermediate support disposed directly below the metal element and directly above the substrate, wherein the intermediate support has no direct physical contact with any of the first electrode and the second electrode, and wherein at least one end of the bridge element is fixed to and in direct physical contact with the intermediate support; and a housing disposed on the substrate and fully covering the metal element and the bridge element, wherein the metal element and the bridge element are located below a top of the housing, wherein the metal element is located above the first and second electrodes and under the bridge element.

2. The protective device as in claim 1, wherein at least one end of the bridge element is fixedly supported on the substrate.

3. The protective device as in claim 2, wherein both ends of the bridge element are fixedly supported on the substrate.

4. The protective device as in claim 1, wherein both ends of the bridge element are fixed to and in physical contact with the intermediate support.

5. The protective device as in claim 1, wherein the bridge element comprises an elongated structure.

6. The protective device as in claim 5, wherein the elongated structure comprises an arc or a bending shape.

7. The protective device as in claim 1, further comprising an auxiliary medium having a portion disposed between the bridge element and the metal element.

8. The protective device as in claim 7, further comprising another auxiliary medium disposed between the metal element and the substrate, wherein said another auxiliary medium having a melting point lower than that of the metal element.

9. The protective device as in claim 7, further comprising a heat-generating element supported by the substrate, providing heat to at least the metal element and the auxiliary medium.

10. The protective device as in claim 9, wherein the bridge element and auxiliary medium are positioned in line with the heat generating element.

11. The protective device as in claim 9, wherein the heat-generating element is supported between the metal element and the substrate.

12. The protective device as in claim 9, wherein the heat-generating element is supported by a side of the substrate away from the metal element.

13. The protective device as in claim 1, further comprising an intermediate layer between the metal element and the intermediate support, wherein the intermediate layer has a fusing temperature lower than the melting temperature of the metal element.

14. The protective device as in claim 7, wherein the auxiliary medium is a flux or a solder layer.

15. The protective device as in claim 1, further comprising a heat insulation portion between a heat-generating element and the first and second electrodes, wherein heat transfer to the intermediate support is at a higher rate than that to the first and second electrodes.

16. The protective device as in claim 1, wherein the intermediate support is an extension of a third electrode coupled to a heat-generating element.

17. The protective device as claimed in claim 1, wherein the substrate comprise a first insulating block, and a second insulating block under the first and second electrodes, wherein a thermal conductivity coefficient of the first insulating bock is greater than that of the second insulating block.

18. The protective device as in claim 1, wherein the first direction is perpendicular to a direction of current flow in the metal element, and a length of the bridge element in the first direction is longer than a length of the metal element in the first direction.

19. The protective device as in claim 1, wherein the intermediate support is an extension of a third electrode that is coupled to a heat-generating element and spaced apart from the first and second electrodes.

20. The protective device as in claim 19, wherein two opposite ends of the bridge element in the first direction are in direct contact with the intermediate support.

21. The protective device as in claim 1, further comprising an auxiliary medium, wherein the intermediate support is located between the first electrode and the second electrode, and the auxiliary medium is located entirely below the metal element, located between the intermediate support and the first electrode, and located between the intermediate support and the second electrode.

22. The protective device as in claim 21, wherein the auxiliary medium is in physical contact with the first electrode, the second electrode and the intermediate support.

* * * * *